US008303073B2

(12) United States Patent
Kubo

(10) Patent No.: US 8,303,073 B2
(45) Date of Patent: Nov. 6, 2012

(54) LIQUID DISCHARGE APPARATUS, CONNECTION INSPECTING METHOD OF THE SAME AND METHOD FOR PRODUCING THE SAME

(75) Inventor: Tomoyuki Kubo, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 301 days.

(21) Appl. No.: 12/728,787

(22) Filed: Mar. 22, 2010

(65) Prior Publication Data

US 2010/0302302 A1 Dec. 2, 2010

(30) Foreign Application Priority Data

May 29, 2009 (JP) ..... 2009-130038

(51) Int. Cl.
*B41J 29/393* (2006.01)
*B41J 2/14* (2006.01)

(52) U.S. Cl. ..... 347/19; 347/50

(58) Field of Classification Search ..... None
See application file for complete search history.

(56) References Cited

U.S. PATENT DOCUMENTS

| | | | | |
|---|---|---|---|---|
| 6,217,144 | B1 | 4/2001 | Myung | |
| 6,752,483 | B1 | 6/2004 | Vega et al. | |
| 8,029,088 | B2 * | 10/2011 | Hosokawa et al. | 347/19 |
| 2002/0140760 | A1 | 10/2002 | Bruch et al. | |
| 2005/0239233 | A1 | 10/2005 | Shinkai | |
| 2006/0061624 | A1 | 3/2006 | Nagashima | |
| 2007/0024661 | A1 * | 2/2007 | Kim et al. | 347/19 |
| 2009/0002461 | A1 | 1/2009 | Suzuki et al. | |
| 2009/0073208 | A1 | 3/2009 | Komatsu et al. | |

FOREIGN PATENT DOCUMENTS

| | | |
|---|---|---|
| JP | H10-58692 | 3/1998 |
| JP | 2000-233520 | 8/2000 |
| JP | 2005-305847 | 11/2004 |
| JP | 2006-088475 | 4/2006 |
| JP | 2007-287417 | 11/2007 |
| JP | 2009-6547 | 1/2009 |
| JP | 2009-066977 | 4/2009 |
| JP | 2009-72973 | 4/2009 |

OTHER PUBLICATIONS

Notice of Reasons for Rejection dated Sep. 4, 2012 received from the Japanese Patent Office from related Japanese Application No. 2010-065704, together with a partial English-language translation.

* cited by examiner

*Primary Examiner* — Geoffrey Mruk
(74) *Attorney, Agent, or Firm* — Scully, Scott, Murphy & Presser, PC

(57) ABSTRACT

A connection inspecting method is provided to inspect the electrical connection between bumps and lands of a printer provided with an ink-jet head, FPC having the lands electrically connected to the bumps formed for the ink-jet head, and a driver IC. The connection inspecting method includes supplying a connection inspecting signal from the driver IC to the ink-jet head; detecting whether or not the ink liquid droplets are discharged from a certain nozzle; and judging whether or not the connection between the bump and the land corresponding to the certain nozzle is the normal connection. The connection inspecting signal is set so that ink liquid droplets are discharged from nozzles only when the connection between the bumps and the lands is the normal connection.

9 Claims, 12 Drawing Sheets

LIQUID DISCHARGE APPARATUS, CONNECTION INSPECTING METHOD OF THE SAME AND METHOD FOR PRODUCING THE SAME

CROSS REFERENCE TO RELATED APPLICATION

The present application claims priority from Japanese Patent Application No. 2009-130038, filed on May 29, 2009, the disclosure of which is incorporated herein by reference in its entirety.

BACKGROUND OF THE INVENTION

1. Field of the Invention

The present invention relates to a liquid discharge apparatus which has a liquid discharge head to be electrically connected to a printed circuit board and in which an inspection for an electrical connection between the printed circuit board and the liquid discharge head is available, a connection inspecting method for the liquid discharge apparatus, and a production method for the liquid discharge apparatus.

2. Description of the Related Art

A liquid discharge apparatus such as an ink-jet printer is provided with a liquid discharge head including nozzles through which a liquid is discharged and a piezoelectric actuator as an example of the pressure-applying mechanism which applies the discharge pressure for discharging the liquid from the nozzles. The liquid is selectively discharged from the nozzles toward a printing medium when the piezoelectric actuator is driven so as to print an image, letters and the like on the printing medium. The piezoelectric actuator is provided with connecting terminals as input terminals. The connecting terminals are electrically connected to terminals of the printed circuit board on which a driver IC is mounted, by the aid of a conductive metal such as solder.

When the piezoelectric actuator and the printed circuit board are connected to one another by using the solder, firstly, the surface of the printed circuit board is masked with a solder resist or the like so that only the terminals of the printed circuit board are exposed, and then the solder is applied onto the terminals. Usually, the solder resist is used as the mask in a state of being cured or solidified. However, the solder resist has such a property that the solder resist is shrunk upon the curing or solidification. Therefore, the following problem arises. That is, the portion on the surface of the printed circuit board is shrunk by the solder resist, and the printed circuit board is curved (warped) and deformed. In a known printer, a piezoelectric actuator and a printed circuit board can be electrically connected to one another without using any solder in order to avoid the problem as described above. The printer is provided with the piezoelectric actuator which has protruding bumps to serve as input terminals and the printed circuit board which has terminals to be connected to the bumps. The surface of the printed circuit board, on which the terminals are formed, is covered with a synthetic resin layer. When the piezoelectric actuator and the printed circuit board are connected to one another, the printed circuit board is pressed against the piezoelectric actuator in a state in which the synthetic resin layer is uncured. In this situation, the bumps penetrate through the synthetic resin layer to be brought in contact with the terminals. The synthetic resin layer is cured while the bumps are brought in contact with the terminals, and thus the printed circuit board and the piezoelectric actuator are physically connected to one another. Accordingly, it is possible to avoid the connection of the printed circuit board to the piezoelectric actuator in a state in which the printed circuit board is curved and deformed. Therefore, the printed circuit board is easily handled when the connection is performed.

It is noted that the following problem may arise in relation to the connection between the piezoelectric actuator and the printed circuit board. For example, the bump fails to penetrate through the synthetic resin layer until the bump is brought in contact with the terminal, and the bump and the terminal are not in contact with each other in some cases, which is caused by the insufficient pressing force to be applied when the connection is made. In other cases, the bump and the terminal are separated from each other, which is caused by the deterioration of the synthetic resin layer due to the moisture or water contained in the atmospheric air. In such situations, the electrical resistance is increased between the bump and the terminal. Therefore, the current, which is required to drive the piezoelectric actuator, is not allowed to flow sufficiently from the power supply in the body. The piezoelectric actuator cannot be driven to discharge the liquid from the nozzles. Therefore, in order to inspect the change of the electrical resistance as described above, an exclusive inspection apparatus has been hitherto used. The inspection apparatus inspects the resistance of the connecting portion between the bump and the terminal such that a pair of inspection probes are brought in contact with the bump and the terminal as the inspection objectives respectively, and the current is allowed to flow from one inspection probe in this state to measure the current allowed to flow through the other inspection probe. Therefore, when the electrical resistance between the bump and the terminal is inspected, it is necessary to perform the inspection such that the pair of inspection probes are expressly brought in contact with the bump and the terminal corresponding to each of the nozzles. A problem arises such that the inspection requires the time and labor.

SUMMARY OF THE INVENTION

In view of the above, an object of the present invention is to provide a connection inspecting method for a liquid discharge apparatus, the liquid discharge apparatus in which the electric connection between a printed circuit board and a pressure-applying mechanism of a liquid discharge head can be simply inspected while avoiding any time-consuming inspection, and a production method for the liquid discharge apparatus.

According to a first aspect of the present invention, there is provided a connection inspecting method for inspecting electrical connection between a first connecting terminal and a second connecting terminal of a liquid discharge apparatus including a liquid discharge head having a nozzle which is formed therein and through which a liquid is discharged, a pressure applying mechanism which applies a discharge pressure to discharge the liquid from the nozzle, and the first connecting terminal which is an input terminal of the pressure applying mechanism; a printed circuit board which has the second connecting terminal electrically connected to the first connecting terminal; and a driver IC which is electrically connected to the printed circuit board and which supplies a signal for driving the pressure applying mechanism to the pressure applying mechanism via the printed circuit board, the connection inspecting method including:

supplying a connection inspecting signal from the driver IC to the pressure applying mechanism, the connection inspecting signal being set so that the liquid is discharged from the nozzle under a condition that the connection between the first connecting terminal and the second connecting terminal is normal connection, and that the liquid is not discharged from the nozzle under a condition that the connection between the first connecting terminal and the second connecting terminal is not the normal connection;

performing a first detection whether or not the liquid is discharged from the nozzle under a condition that the connection inspecting signal is supplied to the pressure applying mechanism; and performing a first judgment whether or not the connection between the first connecting terminal and the second connecting terminal is the normal connection based on a result of the first detection.

According to the first aspect of the present invention, the inspection is performed by supplying the connection inspecting signal from the driver IC to the pressure applying mechanism when the inspection is performed for the electrical connection between the first connecting terminal and the second connecting terminal. The connection inspecting signal is set such that the liquid is discharged from the nozzle only when the connection between the first connecting terminal and the second connecting terminal is the normal connection (regular or formal connection). Therefore, when the connection inspecting signal is supplied from the driver IC to the pressure applying mechanism to detect whether or not the liquid is discharged from the nozzle during this procedure, it is possible to judge whether or not the connection between the first connecting terminal and the second connecting terminal corresponding to the concerning nozzle is the normal connection, in accordance with the detection result. Accordingly, when the inspection is performed for the electrical connection between the printed circuit board and the liquid discharge head, it is possible to perform the inspection for the connection with ease while avoiding any inspection which is based on the use of any inspection apparatus and which requires the time and labor. The term "normal connection" indicates the state of the electrical connection between the first connecting terminal and the second connecting terminal, which refers to the connection effected such that the liquid discharge from the nozzle is not inhibited due to any electrical resistance between the first connecting terminal and the second connecting terminal, and the liquid is normally discharged from the nozzle, when the signal, which is set to discharge the liquid from the nozzle, is supplied from the driver IC to the pressure applying mechanism.

According to a second aspect of the present invention, there is provided a method for producing a liquid discharge apparatus, including:

providing a liquid discharge head in which a liquid channel including a nozzle which is formed therein and through which a liquid is discharged, a pressure applying mechanism which applies a discharge pressure for discharging the liquid from the nozzle, and a first connecting terminal which is electrically connected to the pressure applying mechanism; a liquid tank which stores the liquid to be supplied to the liquid discharge head; a communication channel which communicates the liquid tank with the liquid channel of the liquid discharge head; a printed circuit board which has a second connecting terminal to be electrically connected to the first connecting terminal; and a driver IC which is electrically connected to the printed circuit board and which supplies a signal for driving the pressure applying mechanism to the pressure applying mechanism via the printed circuit board;

connecting the first connecting terminal and the second connecting terminal electrically;

communicating an inspection unit with the liquid discharge head, the inspection unit being provided to supply an inspecting liquid which is used to inspect connection between the first connecting terminal and the second connecting terminal;

supplying the inspecting liquid from the inspection unit into the liquid channel of the liquid discharge head;

supplying a connection inspecting signal from the driver IC to the pressure applying mechanism after the inspecting liquid is supplied to the liquid channel, the connection inspecting signal being set so that the inspecting liquid is discharged from the nozzle under a condition that the connection between the first connecting terminal and the second connecting terminal is normal connection, and that the inspecting liquid is not discharged from the nozzle under a condition that the connection between the first connecting terminal and the second connecting terminal is not the normal connection;

performing a first detection whether or not the inspecting liquid is discharged from the nozzle under a condition that the connection inspecting signal is supplied to the pressure applying mechanism;

performing a first judgment whether or not the connection between the first connecting terminal and the second connecting terminal corresponding to the nozzle is the normal connection based on a result of the first detection; and assembling the liquid discharge head by detaching the inspection unit and by communicating the communication channel with the liquid discharge head under a condition that the first judgment is made that the connection between the first connecting terminal and the second connecting terminal is the normal connection.

According to the second aspect of the present invention, the inspection is performed by supplying the connection inspecting signal from the driver IC to the pressure applying mechanism in order to perform the inspection for the electrical connection between the first connecting terminal and the second connecting terminal when the liquid discharge apparatus is produced. The connection inspecting signal is set such that the liquid is discharged from the nozzle only when the connection between the first connecting terminal and the second connecting terminal is the normal connection. Therefore, when the connection inspecting signal is supplied from the driver IC to the pressure applying mechanism to detect whether or not the liquid is discharged from the nozzle during this procedure, it is possible to judge whether or not the connection between the first connecting terminal and the second connecting terminal corresponding to the concerning nozzle is the normal connection, in accordance with the detection result. Further, the inspection unit is communicated with the liquid discharge head to supply the inspecting liquid into the liquid flow passage before the connection inspecting signal is supplied from the driver IC to the pressure applying mechanism. When the inspection is performed for the connection, the inspection can be performed for the connection by using the inspecting liquid. Therefore, it is possible to avoid the execution of the connection inspection by utilizing any liquid stored for a long period of time in the liquid discharge head. Therefore, it is possible to avoid such a situation that the liquid is not discharged from the nozzle due to the increase in the viscosity of the liquid when the inspection is performed for the connection. Accordingly, when the inspection is performed for the electrical connection between the printed circuit board and the liquid discharge head, it is possible to correctly perform the inspection for the electrical connection between the first connecting terminal and the second connecting terminal.

According to a third aspect of the present invention, there is provided a liquid discharge apparatus which discharges a liquid, including:

a liquid discharge head having a nozzle which is formed therein and through which the liquid is discharged, a pressure applying mechanism which applies a discharge pressure to discharge the liquid from the nozzle, and a first connecting terminal which is an input terminal of the pressure applying mechanism;

a printed circuit board which has a second connecting terminal electrically connected to the first connecting terminal;

a driver IC which is electrically connected to the printed circuit board and which supplies a signal for driving the pressure applying mechanism to the pressure applying mechanism via the printed circuit board;

a discharge detecting mechanism which detects whether or not the liquid is discharged from the nozzle under a condition that the signal is supplied to the pressure applying mechanism;

a connection inspecting mechanism which inspects electrical connection between the first connecting terminal and the second connecting terminal and which controls the driver IC to supply a connection inspecting signal to the pressure applying mechanism, the connection inspecting signal being set so that the liquid is discharged from the nozzle under a condition that the connection between the first connecting terminal and the second connecting terminal is normal connection, and that the liquid is not discharged from the nozzle under a condition that the connection between the first connecting terminal and the second connecting terminal is not the normal connection; and the connection inspecting mechanism controlling the discharge detecting mechanism to detect whether or not the liquid is discharged from the nozzle under a condition that the connection inspecting signal is supplied to the pressure applying mechanism; and a judging mechanism which performs judgment whether or not the connection between the first connecting terminal and the second connecting terminal corresponding to the nozzle is the normal connection based on a detection result of the discharge detecting mechanism.

According to the third aspect of the present invention, when the inspection is performed for the electrical connection between the first connecting terminal and the second connecting terminal, then the connection inspecting mechanism controls the driver IC so that the connection inspecting signal is supplied from the driver IC to the pressure applying mechanism, and the connection inspecting mechanism controls the discharge detecting mechanism in order to detect whether or not the liquid is discharged from the nozzle when the connection inspecting signal is supplied. The judging mechanism judges whether or not the connection between the first connecting terminal and the second connecting terminal is the normal connection on the basis of the detection result of the discharge detecting mechanism. The connection inspecting signal is set such that the liquid is discharged from the nozzle only when the connection between the first connecting terminal and the second connecting terminal is the normal connection. Therefore, the judging mechanism can judge whether or not the connection between the first connecting terminal and the second connecting terminal is the normal connection, on the basis of the detection result of the discharge detecting mechanism. Accordingly, it is possible to perform the inspection for the connection with ease while avoiding any inspection which is based on the use of any inspection apparatus for inspecting the resistance and which requires the time and labor.

According to the present invention, it is possible to perform the inspection for the connection with ease while avoiding any inspection which requires the time and labor, when the inspection is performed for the electrical connection between the printed circuit board and the pressure applying mechanism of the liquid discharge head.

BRIEF DESCRIPTION OF THE DRAWINGS

FIG. 6 illustrates a signal to be used for the ordinary printing and a connection inspecting signal, wherein

DESCRIPTION OF THE PREFERRED EMBODIMENTS

Next, a preferred embodiment of the present teaching will be explained. In this embodiment, the present teaching is exemplarily applied to an ink-jet head as the liquid discharge apparatus which discharges inks from nozzles.

Figure 1:
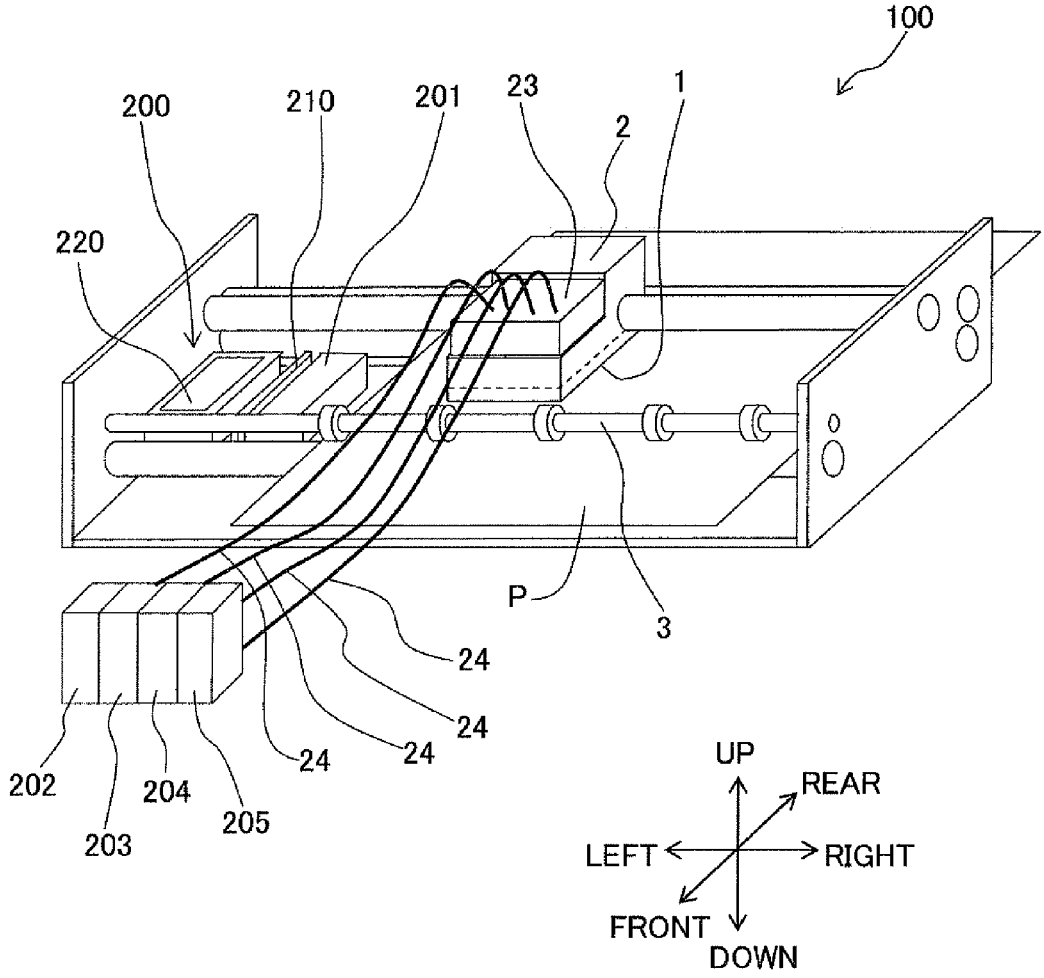
FIG. 1 shows a schematic arrangement of a printer 100.

At first, an explanation will be made about a printer provided with the ink-jet head. As shown in FIG. 1, the printer 100 includes the ink-jet head 1 (liquid discharge head) which discharges the inks, a carriage 2 which carries the ink-jet head 1, a transport roller 3, a maintenance unit 200, a dot missing detecting device 201 (discharge detecting mechanism), and ink cartridges 202 to 205 (liquid tanks).

The ink-jet head 1 is integrally moved in the left-right direction (scanning direction) as shown in FIG. 1 together with the carriage 2, while the inks supplied from the ink cartridges 202 to 205 are discharged from the nozzles 20 (see FIGS. 2 and 3) arranged on the lower surface thereof toward the recording paper P. The carriage 2 is connected to a CR motor (not shown) which is provided in the printer 100. The carriage 2 is moved by the CR motor in the left-right direction. The transport roller 3 transports the recording paper P in the frontward direction (transport direction, paper feeding direction) as shown in FIG. 1. In the printer 100, the recording paper P is transported frontwardly or in the frontward direction by means of the transport roller 3 while discharging the inks from the nozzles 20 of the ink-jet head 1 to the recording paper P. Accordingly, the printer 100 prints, for example, a desired image and/or letters on the recording paper P.

The maintenance unit 200 has a cap 220 which can be brought in tight contact with the lower surface of the ink-jet head 1 on which the nozzles 20 are formed. The interior of the cap 220 is communicated with a suction pump 87 (see FIG. 4). The inks are discharged from the nozzles 20 by driving the suction pump 87 in a state in which the cap 220 is brought in tight contact with the lower surface 13*a* (see FIG. 3) of the ink-jet head 1. In this procedure, the new inks are allowed to inflow from the ink cartridges to the nozzles 20, and it is possible to recover the nozzles 20 from being dried.

The dot missing detecting device 201 is provided with a light-emitting section (not shown) which emits the laser, a light-receiving section (not shown) which receives the laser, and a foam such as a sponge (not shown) which receives the inks. The dot missing detecting device 201 is connected to a detection control section 82 (see FIG. 4) which is provided for the printer 100. The detection control section 82 controls the light-emitting section and the light-receiving section. Accordingly, the detection control section 82 detects whether or not the liquid droplets of the inks are discharged from the nozzles 20, based on the light amount of the laser received by the light-receiving section. When it is detected whether or not the ink liquid droplets are discharged, then the ink-jet head 1 is positioned at the position opposed to the dot missing detecting device 201 (position at which the ink-jet head 1 and the dot missing detecting device 201 are overlapped with each other as viewed from above), and the ink liquid droplets are discharged while the laser is radiated from the light-emitting section. In this situation, when the discharged ink liquid droplets fly across the laser, then the laser is intercepted, and the light amount of the laser received by the light-receiving section is decreased. On the contrary, when the ink liquid droplets are not discharged from the nozzles 20, the light amount of the laser received by the light-receiving section is not changed. Accordingly, the detection control section 82 can detect whether or not the ink liquid droplets are discharged from the nozzles 20. The flashing operation is performed while discharging the inks toward the foam as described later on.

Figure 2:
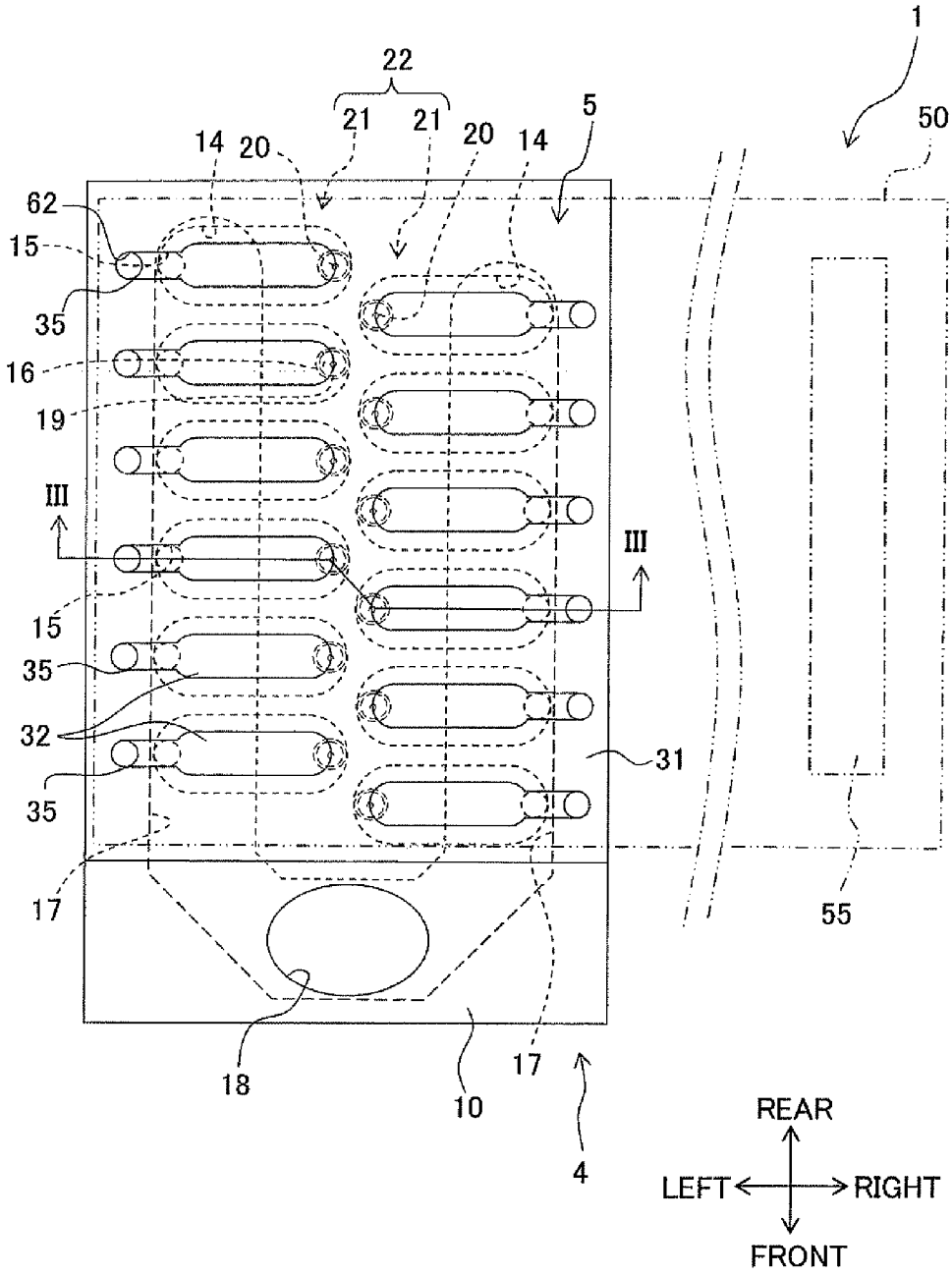
FIG. 2 shows a partial plan view illustrating an ink-jet head 1.
Figure 3:
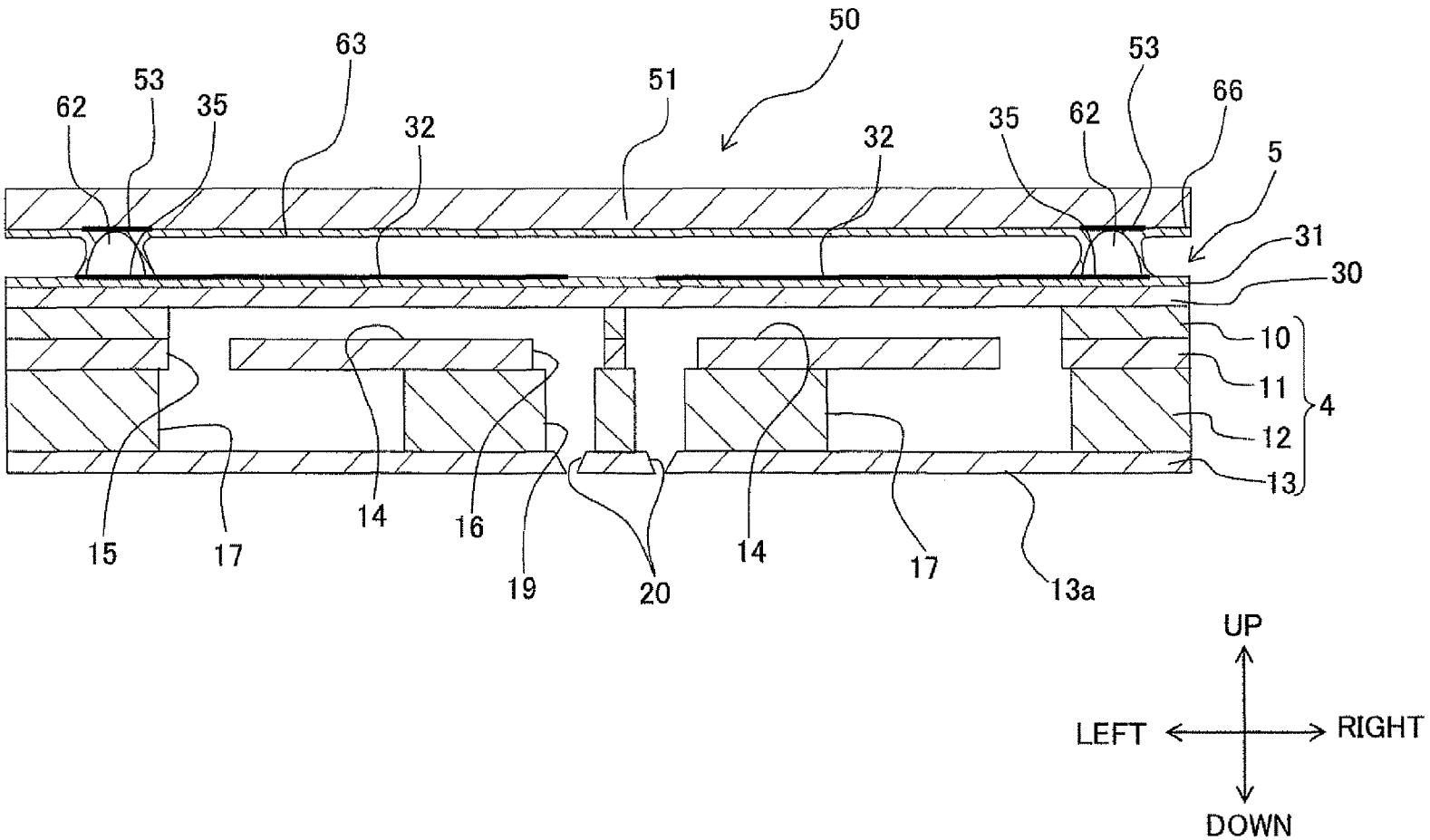
FIG. 3 shows a sectional view taken along a line III-III shown in FIG. 2.

Next, the ink-jet head 1 will be explained. As shown in FIGS. 2 and 3, the ink-jet head 1 is provided with a channel unit 4, a piezoelectric actuator 5 (pressure applying mechanism), a flexible printed circuit board 50 (hereinafter referred to as "FPC 50"), and a driver IC 55 (signal supply mechanism) which is mounted on FPC 50. The channel unit 4 is formed with ink flow passages or ink channels including the nozzles 20 and pressure chambers 14. The discharge pressure, which is provided for discharging the ink liquid droplets from the nozzles 20, is applied by the piezoelectric actuator 5 to the inks contained in the pressure chambers 14. FPC 50 electrically connects the piezoelectric actuator 5 and the driver IC 55.

At first, the channel unit 4 will be explained. As shown in FIG. 3, the channel unit 4 has a cavity plate 10, a base plate 11, a manifold plate 12, and a nozzle plate 13. The channel unit 4 is constructed by joining the four plates 10 to 13 in a stacked state.

The cavity plate 10 is provided with the plurality of pressure chambers 14. The plurality of pressure chambers 14 are arranged along a plane direction of the cavity plate 10. Further, the plurality of pressure chambers 14 have substantially elliptical shapes which are elongated in the left-right direction as viewed in a plan view. The plurality of pressure chambers 14 are arranged in a staggered form in the front-back direction. One set of pressure chamber group 22, which corresponds to one color ink, is formed by two arrays of the pressure chambers 21 arranged in the staggered form. Further, a plurality of sets of pressure chamber groups 22, which correspond to the plurality of color inks (for example, four colors of cyan, magenta, yellow, and black) respectively, are arranged side-by-side in the left-right direction. FIG. 2 shows a partial top view illustrating only a partial area of the upper surface of the ink-jet head 1. Therefore, FIG. 2 shows only the two arrays of pressure chambers 21 belonging to one set of pressure chamber group 22.

The base plate 11 has communication holes 15, 16. The communication holes 15, 16 are positioned while being overlapped with both end portions of the pressure chambers 14 as viewed in a plan view, and they are communicated with the pressure chambers 14.

A manifold 17 and communication holes 19 are formed in the manifold plate 12. The manifold 17 is overlapped with the pressure chambers 14 on the side of the communication holes 15 as viewed in a plan view, and the manifold 17 is arranged to extend in the front-back direction. The manifold 17 is communicated with one ink supply port 18 formed in the cavity plate 10. The ink supply port 18 is communicated with each of subtanks 23 carried on the carriage 2. The subtanks 23 are connected to the ink cartridges 202 to 205 via tubes 24. The inks are supplied thereto from the ink cartridges 202 to 205. The communication holes 19 are arranged so as to be overlapped with the end portions of the plurality of pressure chambers 14 disposed on the side opposite to the end portions communicated with the manifold 17 as viewed in a plan view, and the communication holes 19 are connected to the communication holes 16.

The nozzle plate 13 has the plurality of nozzles 20. The plurality of nozzles 20 are arranged at the positions overlapped with the plurality of communication holes 19 as viewed in a plan view. As shown in FIG. 2, the nozzles 20 are arranged so that the nozzles 20 are overlapped with the end portions of the corresponding pressure chambers 14 disposed on the side opposite to the end portions communicated with the manifold 17 respectively. Accordingly, the plurality of nozzles 20 are arranged in a staggered form corresponding to the plurality of pressure chambers 14 respectively.

The channel unit 4, which is constructed as described above, is provided with the plurality of ink channels (liquid channels) ranging from the manifold 17 via the pressure chambers 14 to arrive at the nozzles 20. The subtanks 23 and the tubes 24 of this embodiment are examples of the "communication channel" of the present teaching.

Next, the piezoelectric actuator 5 will be explained. As shown in FIGS. 2 and 3, the piezoelectric actuator 5 is provided with a vibration plate 30, a piezoelectric layer 31 which is arranged on the upper surface of the vibration plate 30, a plurality of individual electrodes 32 which are provided on the upper surface of the piezoelectric layer 31, terminal portions 35 which are connected to the individual electrodes 32 respectively, and a plurality of bumps 62 (first connecting terminals) which protrude from the terminal portions 35.

The vibration plate 30 is joined to the upper surface of the channel unit 4. The vibration plate 30 is arranged to cover the pressure chambers 14. The vibration plate 30 is a metal plate which is substantially rectangular as viewed in a plan view. The vibration plate 30 is formed of, for example, an iron-based ally such as stainless steel, a copper-based alloy, a nickel-based alloy, or a titanium-based alloy. The piezoelectric layer 31 is stacked on the upper surface of the vibration plate 30. Further, the plurality of individual electrodes 32 are stacked on the upper surface of the piezoelectric layer 31. The vibration plate 30 is arranged such that the piezoelectric layer 31 is sandwiched between the vibration plate 30 and the plurality of individual electrodes 32. The vibration plate 30 also functions as the common electrode to generate the electric field in the piezoelectric layer 31 in the thickness direction thereof. The vibration plate 30 is connected to the driver IC 55 via an unillustrated ground wiring line of FPC 50, and the vibration plate 30 is always retained at the ground electric potential.

The piezoelectric layer 31 is formed of a piezoelectric material containing a main component of lead titanate zirconate (PZT) which is a ferroelectric and which is a solid solution of lead titanate and lead zirconate. The piezoelectric layer 31 is formed continuously to cover the plurality of pressure chambers 14.

The plurality of individual electrodes 32 have substantially elliptical planar shapes which are one size smaller than those of the pressure chambers 14. The plurality of individual electrodes 32 are arranged in the areas opposed to the central portions of the plurality of pressure chambers 14 respectively. The individual electrode 32 is formed of a conductive material including, for example, gold, copper, silver, palladium, platinum, and titanium.

The plurality of terminal portions 35 are led to the outer area beyond the circumferential edges of the pressure chambers 14 from the end portions of the plurality of individual electrodes 32 disposed on the side of the communication holes 15. The plurality of bumps 62 are formed of a conductive material such as silver. The plurality of bumps 62 are brought in contact with lands 53 of FPC 50. The bumps 62 and the lands 53 are electrically connected to one another by being brought in contact with each other. The respective individual electrodes 32 are electrically connected to the driver IC 55 (see FIG. 2) mounted on FPC 50 via the bumps 62 and the lands 53 of FPC 50.

Next, an explanation will be made about FPC 50 mounted with the driver IC 55. As shown in FIG. 3, FPC 50 is provided with a base member 51, the plurality of lands 53 (second connecting terminals) which are provided on the lower surface of the base member 51, the driver IC 55, and a synthetic resin layer 63 which is stacked on the lower surface of the base member 51. FPC 50 is arranged over or above the piezoelectric actuator 5 such that a predetermined spacing distance is formed between the FPC 50 and the piezoelectric actuator 5. FPC 50 is led in the rightward direction.

The base member 51 is formed of an insulative resin material such as polyimide. The base member 51 has the flexibility. The plurality of lands 53 are provided at the positions opposed to the plurality of bumps 62 respectively. The plurality of lands 53 are brought in contact with the plurality of bumps. The plurality of lands 53 are formed of a conductive material such as silver and platinum.

The synthetic resin layer 63 is formed of a thermosetting material such as epoxy resin. The synthetic resin layer 63 covers the surfaces of the lands 53 and the bumps 62, and the synthetic resin layer 63 is spread on the terminal portions 35 of the piezoelectric actuator 5. In this way, the lands 53 and the bumps 62 can be electrically connected to one another by using the synthetic resin layer 63. Therefore, it is possible to avoid the flow of the solder via the terminal portions 35 to the individual electrodes 32 upon the connection as compared with those in which the connection is effected by utilizing any conductive metal such as the solder. Accordingly, it is possible to avoid such an inconvenience that the solder is cured or solidified while being allowed to flow into the individual electrodes 32. Therefore, the inhibition of the driving operation of the driving area of the piezoelectric layer 31 of the piezoelectric actuator 5 is prevented.

The driver IC 55 supplies the signal in order to drive the piezoelectric actuator 5. The driver IC 55 is arranged in the area of FPC 50 led in the right direction. Further, the driver IC 55 is connected to a plurality of unillustrated wiring lines of FPC 50 respectively. The driver IC 55 is electrically connected to the plurality of lands 53 via the plurality of wiring lines. When the printing data is supplied to the driver IC 55 from an input device 79 (see FIG. 5) such as PC or the like, the driver IC 55 supplies the signal to the plurality of individual electrodes 32 on the basis of the printing data. When the signal is supplied from the driver IC 55 to the individual electrode 32, the individual electrode 32 is switched between the predetermined driving electric potential and the ground electric potential. Accordingly, the piezoelectric actuator 5 applies the discharge pressure to the ink contained in the pressure chamber 14, and the ink is discharged from the nozzle 20.

Figure 4:
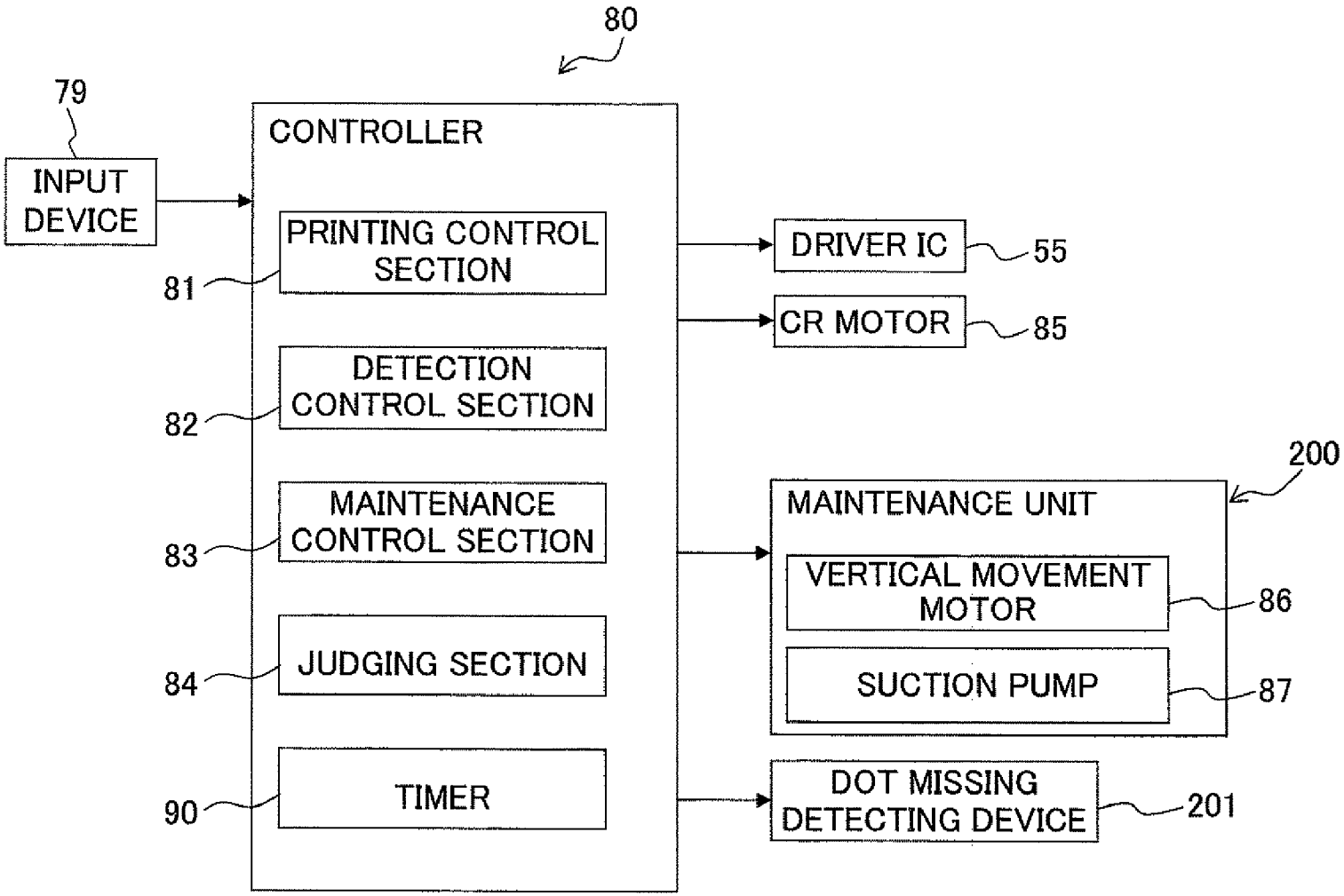
FIG. 4 schematically shows an electrical arrangement of the printer 100.

Next, the electrical arrangement of the printer 100 will be explained with reference to FIG. 4. As shown in FIG. 4, the printer 100 is provided with a controller 80. In this arrangement, the controller 80 may include, for example, a Central Processing Unit (CPU), a Read Only Memory (ROM) which stores various programs and data for controlling the overall operation of the printer 100, and a Random Access Memory (RAM) which temporarily stores, for example, the data to be processed by CPU, wherein the program stored in ROM is executed by CPU, and thus various types of control as described below are performed on the basis of software. Alternatively, the controller 80 may be realized by any hardware provided by combining various circuits including a computing circuit.

The controller 80 is provided with a printing control section 81, a maintenance control section 82, the detection control section 83, a judging section (judging mechanism) 84, and a timer 90. The printing control section 81 controls the CR motor 85 to reciprocatively move the carriage 2 in the left-right direction on the basis of the printing data inputted from an input device 79. Further, the printing control section 81 controls the driver IC 55 to discharge the ink liquid droplets from the nozzles 65. Further, the printing control section 81 controls the transport roller 3 so that the printing paper P is transported in the frontward direction. In accordance with the control performed as described above, for example, a desired image is printed on the printing paper P.

The maintenance control section 82 controls a suction pump 87 and a vertical movement mechanism 86 connected to the maintenance unit 200 so that the suction operation (purge operation) is performed to discharge the inks and the bubbles from the nozzles 20 of the ink-jet head 1.

The detection control section 83 is connected to the dot missing detecting device 201. The detection control section 83 controls the light-emitting section and the light-receiving section. Further, the detection control section 83 detects whether or not the ink liquid droplets are discharged from the nozzles 20 on the basis of the light amount of the laser detected by the light-receiving section.

The judging section 84 judges the connection state of the land 53 and the bump 62 on the basis of the detection result of the detection control section 83 when the connection inspection is performed to inspect the connection state of the land 53 and the bump 62 as explained later on.

The timer 90 measures the elapsed time after the connection inspection is performed for the land 53 and the bump 62.

Figure 5:
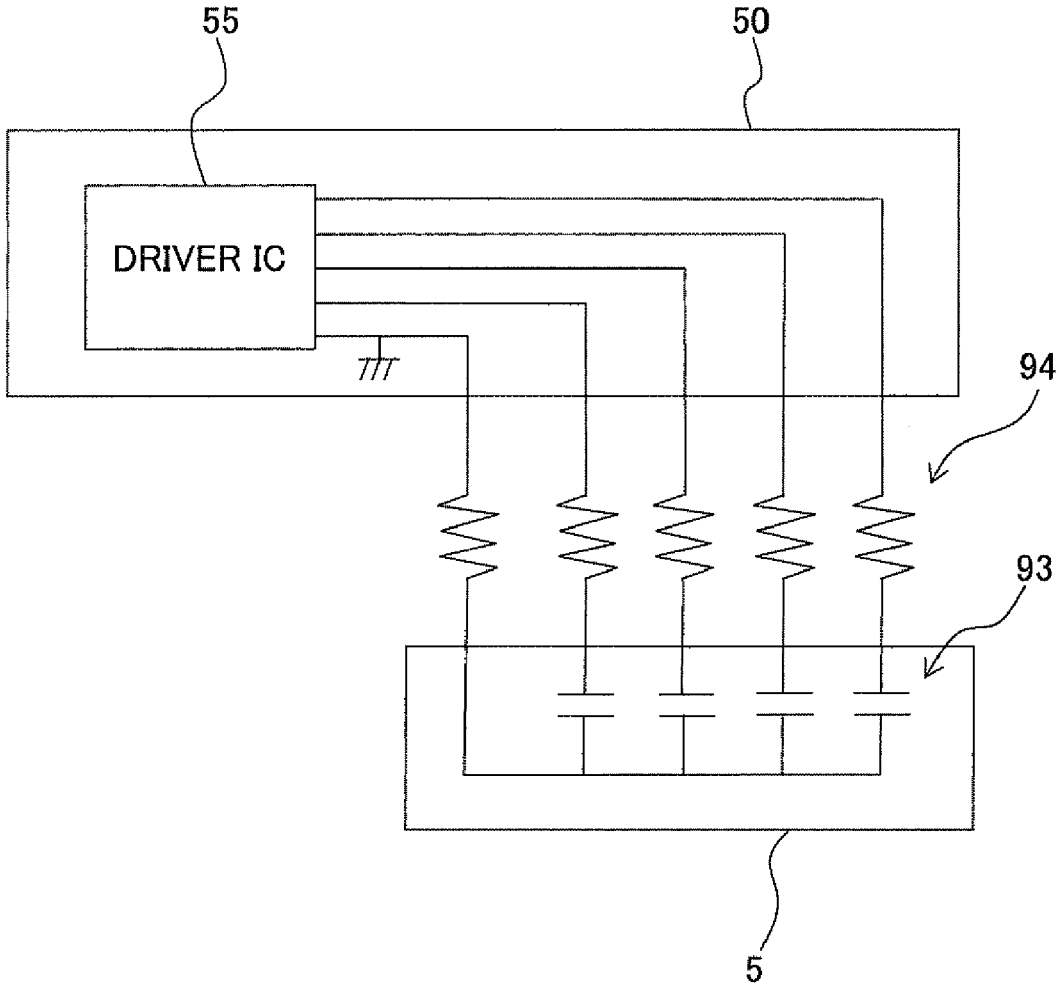
FIG. 5 shows an equivalent circuit diagram illustrating an electrical arrangement ranging from a driver IC 55 to a piezoelectric actuator 5.

Next, an explanation will be made about the electrical arrangement ranging from the driver IC 55 to the piezoelectric actuator 5. As shown in FIG. 5, in relation to the piezoelectric actuator 5, the driving areas of the piezoelectric layer 31, which are polarized and which are interposed between the vibration plate 30 and the individual electrodes 32, are assumed to be equivalent to capacitors 93. The connecting portions disposed between the lands 53 of FPC 50 and the bumps 62 of the piezoelectric actuator 5 are assumed to be equivalent to resistors 94 included in the circuit.

In this way, the ink-jet head 1 can be assumed to be equivalent to an RC circuit in which the resistors 94 are inserted in series at intermediate positions of the circuit for applying the voltage from the driver IC 55 to the capacitors 93 for performing the electric charge and discharge of the piezoelectric actuator 5 as the driving objective.

In this arrangement, when the ink-jet head 1 is regarded as the RC circuit, the resistance components of the circuit include various resistance components such as the wiring resistances of the unillustrated wiring lines of FPC 50. However, in particular, the electrical resistances (resistance values of the resistors 94), which are provided in the connection between the lands 53 and the bumps 62, occupy a large ratio, for the following reason.

That is, the connection between the land 53 and the bump 62 does not reside in the strong physical connection based on the use of any conductive material such as the solder or the like, but the connection between the land 53 and the bump 62 merely resides in the electrical connection brought about by the simple contact. The electrical connection resistance between the land 53 and the bump 62 correlates with the size of the contact area between the land 53 and the bump 62. In other words, if the contact area is small, the resistance value is increased.

For example, if the contact between the land 53 and the bump 62 is insufficient for any reason including, for example, any insufficient pressing of FPC 50 against the piezoelectric actuator 5, then the contact area between the land 53 and the bump 62 is decreased, and the electrical resistance is increased at the connecting portion between the land 53 and the bump 62. In this situation, the voltage waveform of the signal, which is provided by the signal applied from the driver IC 55 to the individual electrode 32 of the piezoelectric actuator 5, is dulled. The discharge pressure applied to the ink contained in the ink flow passage corresponding to the individual electrode 32 is decreased, and the discharge timing is deviated. Therefore, it is impossible to obtain any desired discharge characteristic. The phrase "the voltage waveform of the signal is dulled or damped" herein refers to, for example, the fact that the rising time (falling time) of the signal is prolonged. In general, the time constant of the RC circuit is determined by the product of the resistance value and the capacitance of the capacitor. Therefore, as the electrical resistance is more increased at the connecting portion between the land 53 and the bump 62, the rising time of the signal is more prolonged. In this case, the signal applied to the individual electrode 32 falls before arriving at the assumed maximum voltage. Therefore, the voltage applied to the individual electrode 32 is lowered. Therefore, it is desirable to connect both of the land 53 and the bump 62 so that the contact area between the land 53 and the bump 62 is increased in order that the voltage waveform of the signal applied to the individual electrode 32 is not dulled, i.e., in order that the electrical resistance is not increased at the connecting portion between the land 53 and the bump 62.

As described above, the electrical resistance provided at the connecting portion between the land 53 and the bump 62 greatly affects the ink discharge characteristic of the ink jet head 1. Therefore, in order to know whether or not the electrical resistance between the land 53 and the bump 62 is larger than a desired resistance value, it is desired to measure the magnitude of the resistance during the production of the ink-jet head 1 and/or to measure the magnitude of the resistance during the driving of the printer 100. However, in order to measure the connection resistance between the land 53 and the bump 62 by the ordinary method, it is necessary that any measuring apparatus having a pair of inspection probes should be expressly prepared, and the pair of inspection probes of the measuring apparatus should be allowed to make contact with the land 53 and the bump 62 respectively to measure the connection resistance, in which the inspection step is complicated. Further, after the ink-jet head 1 is assembled, it is difficult to correctly insert the pair of inspection probes of the measuring apparatus into the space between FPC 50 and the piezoelectric actuator 5, in which it has been technically difficult to directly measure the connection resistance. It is also conceived that the contact area between the land 53 and the bump 62 is measured to estimate the connection resistance from the contact area. However, in order to measure the contact area, it is necessary that the land 53 and the bump 62 should be released from the contact, that is, it is necessary that the land 53 and the bump 62 should be separated. Further, it has been also difficult to measure the contact area.

In view of the above, this embodiment provides the connection inspecting method which makes it possible to inspect the electrical connection between the land 53 and the bump 62 simply even after assembling the ink-jet head 1. In this connection inspecting method, the connection inspecting signal for performing the inspection is supplied from the driver IC 55 after connecting FPC 50 to the piezoelectric actuator 5, in order to detect whether or not the ink is discharged from the nozzle 20 to which the connection inspecting signal is supplied. Accordingly, the magnitude of the electrical resistance between the land 53 and the bump 62 is judged.

Figure 6A:
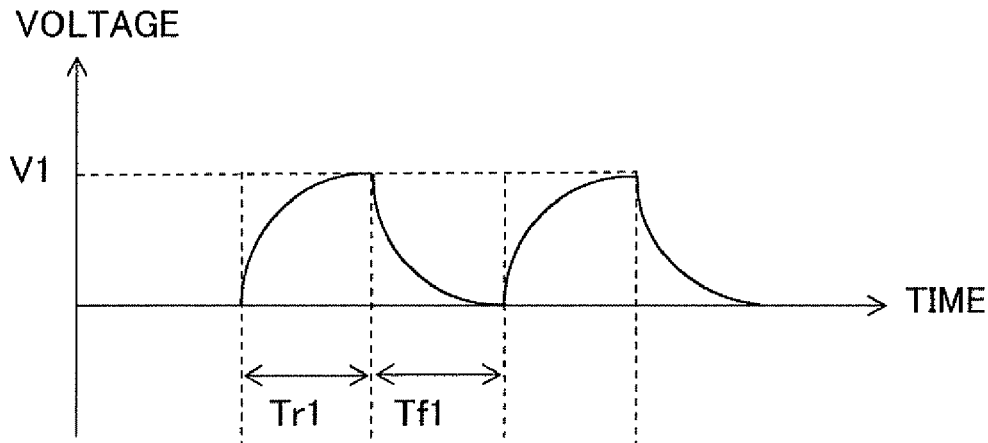
FIG. 6A shows a voltage waveform of the signal to be used for the ordinary printing.
Figure 6B:
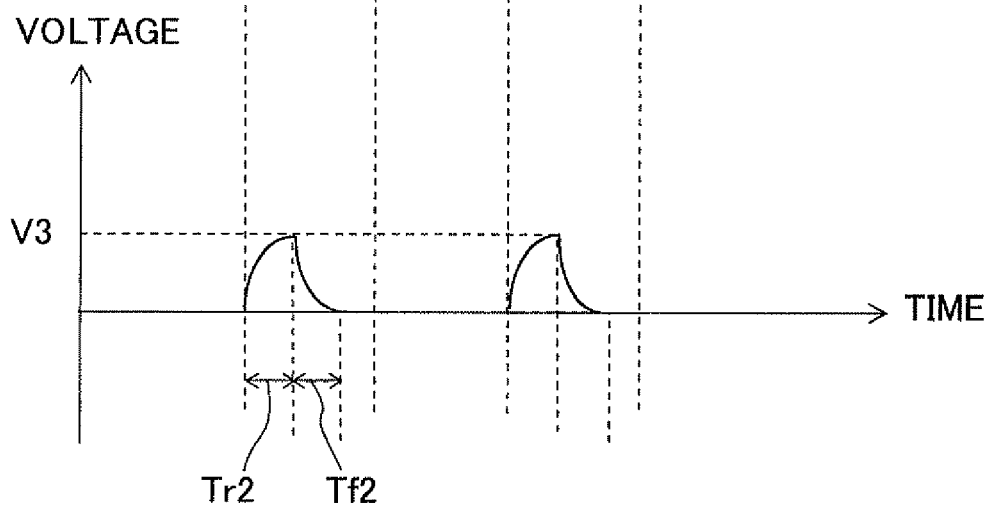
FIG. 6B shows a voltage waveform of the connection inspecting signal.

The connection inspecting signal will now be explained with reference to FIGS. 6A and 6B. As shown in FIGS. 6A and 6B, the pulse width Tr2 of the connection inspecting signal is smaller than the pulse width Tr1 of the signal to be used for the ordinary printing. Therefore, the voltage V3, which is charged to the piezoelectric actuator 5 when the connection inspecting signal is supplied from the driver IC 55, is smaller than the voltage V1 which is charged to the piezoelectric actuator 5 when the ordinary printing is performed. Therefore, the voltage applied to the individual electrode 32 of the piezoelectric actuator 5 becomes small, and the amount of deformation of the piezoelectric layer 31 becomes small. Accordingly, the change amount to change the pressure chamber 14 becomes small as well. Therefore, the volumes of the discharged ink liquid droplets are smaller than those provided during the ordinary printing. Further, the pulse waveform of the connection inspecting signal (for example, the pulse width and/or the pulse height) is set so that only when the deformation amount is slightly decreased (for example, by about several tens %) as compared with the deformation amount of the piezoelectric layer 31 to be provided when the connection inspecting signal is supplied, it is impossible to apply the discharge pressure required to discharge the ink liquid droplets, i.e., the ink liquid droplets are not discharged from the nozzle 20 of the ink-jet head 1. In other words, if the land 53 and the bump 62 are normally connected to one another in a certain signal wiring line, then the connection resistance is sufficiently small between the land 53 and the bump 62, and the voltage waveform of the signal applied to the individual electrode 32 is not dulled. Therefore, the ink liquid droplets are discharged from the nozzle 20 of the ink-jet head 1. However, if the land 53 and the bump 62 are not normally connected to one another, and the connection resistance is increased therebetween, then the voltage waveform of the connection inspecting signal applied to the individual electrode 32 of the piezoelectric actuator 5 is dulled when the connection inspecting signal is supplied from the driver IC. The ink liquid droplets are not discharged from the nozzle 20 corresponding to the concerning individual electrode 32. Therefore, it is possible to judge whether or not the electrical resistance, which is provided at the connecting portion between the land 53 and the bump 62, is larger than the resistance value at which the desired discharge characteristic is obtained, by detecting whether or not the ink liquid droplets are discharged from the nozzle 20 when the connection inspecting signal is supplied from the driver IC 55.

The "normal connection" referred to in the present teaching resides in, for example, the state in which the land 53 and the bump 62 are connected to one another so that the contact area between the land 53 and the bump 62 is large, and the voltage waveform of the signal is not dulled to obtain the desired discharge characteristic when the signal is applied to the individual electrode 32.

Figure 7:
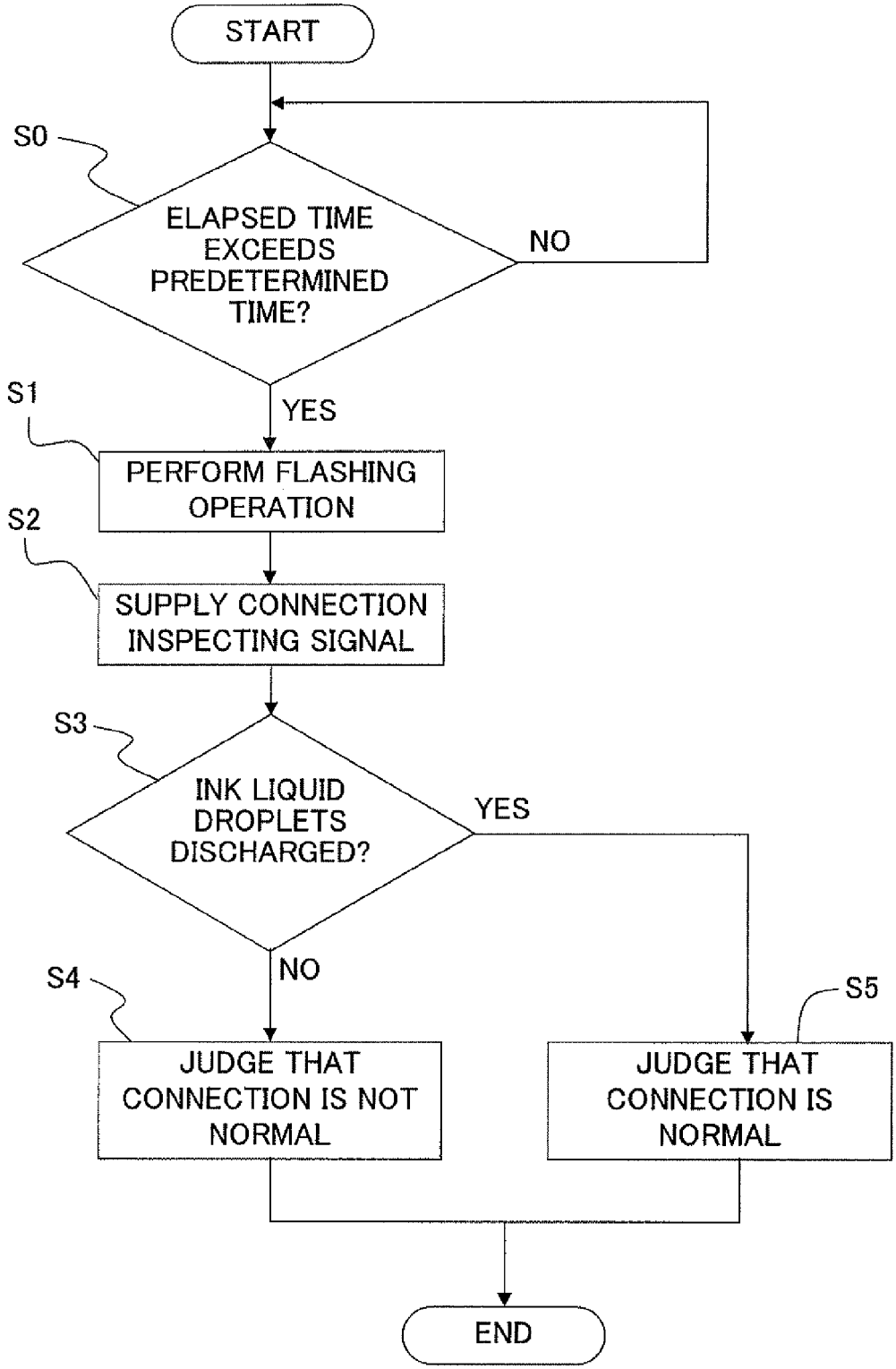
FIG. 7 shows a flow chart illustrating the connection inspection for a land 52 and a bump 63.

Next, an explanation will be made with reference to FIG. 7 about a method for inspecting the connection between the land 53 and the bump 62 in relation to the printer 100 of this embodiment.

At first, the controller 80 judges whether or not the elapsed time, which is measured by the timer 90, exceeds a predetermined time (S0). If the controller 80 judges that the elapsed time exceeds a predetermined time (S0:YES), then the CR motor 85 is controlled to move the carriage 2 so that the ink-jet head 1 is positioned at the position opposed to the dot missing detecting device 201. The flashing signal is supplied to the ink-jet head 1 so that the ink-jet head 1 performs the flashing operation (S1: hereinafter called as "recovering step"). Subsequently, the printing control section 81 is controlled so that the connection inspecting signal described above is supplied from the driver IC 55 to the ink-jet head 1 (S2: hereinafter called as "supplying step"). After a predetermined time elapses after supplying the connection inspecting signal, it is detected whether or not the ink liquid droplets are discharged from the nozzles 20 (S3: hereinafter called as "first detecting step"). If the detection control section 82 does not detect the discharge of the ink from the nozzles 20 (S3: NO), the judging section 84 judges that the connection between the lands 53 and the bumps 62 corresponding to the nozzles 20 not detected with the ink discharge is not the normal connection (S4: hereinafter called as "first judging step").

On the other hand, if the detection control section 82 detects the discharge of the ink from the nozzles 20 in Step S2 described above (S3: YES), the judging section 84 judges that the connection between the lands 53 and the bumps 62 corresponding to the nozzles 20 detected with the ink discharge is the normal connection (S4).

In the connection inspecting method described above, the connection inspecting signal is set or established so that the ink liquid droplets can be discharged from the nozzles 20 if the connection between the land 53 and the bump 62 is the normal connection, but the connection inspecting signal is set or established so that the ink liquid droplets are not discharged if the connection between the land 53 and the bump 62 is not the normal connection. That is, if the connection between the land 53 and the bump 62 is not the normal connection, then the discharge pressure applied to the ink contained in the pressure chamber 14 by the piezoelectric actuator 5 is decreased, and the ink liquid droplets are not discharged from the nozzle 20. Therefore, it is possible to judge whether or not the connection between the land 53 and the bump 62 is the normal connection by detecting whether or not the ink liquid droplets are discharged from the nozzles 20. In order to improve the accuracy of the inspection, a plurality of pieces of the connection inspecting signal may be supplied from the driver IC 55 to the ink jet head 1 for each of the nozzles such that a plurality of ink liquid droplets is discharged from each of the nozzles during the inspection.

The connection inspection as described above is performed if the controller 80 judges that the elapsed time, which is measured by the timer 90, exceeds the predetermined time. The reason, why the connection inspection is performed while judging the elapsed time as described above, is that the connection between the land 53 and the bump 62 is changed depending on the elapse of time. When the synthetic resin layer 63, which covers the land 53 and the bump 62, is exposed in the atmospheric air for a long period of time, the synthetic resin layer 63 is expanded while containing the moisture or water in the atmospheric air. The joining strength of the synthetic resin layer 63, which is provided at the joining interface with respect to FPC 50, is weakened by the expansion. In this case, it is feared that the connection between the land 53 and the bump 62 may be weakened and that the electrical resistance of the connection between the land 53 and the bump 62 may be increased. The synthetic resin layer 63 is exfoliated from FPC 50 in some cases. It is feared that the land 53 and the bump 62 may be separated from each other and no conduction may be effected when the synthetic resin layer 63 is exfoliated from FPC 50 as described above. However, the frequency of the exfoliation of the synthetic resin layer 63 from FPC 50 is low, and it is unnecessary to perform the inspection frequently. Therefore, when the connection inspection is performed if the elapsed time described above exceeds the predetermined time, then the inspection is performed only when the connection between the land 53 and the bump 62 is not the normal connection highly possibly, and it is possible to suppress the consumption of the ink to be consumed by the connection inspection. For example, the inspection may be performed at a frequency of about once a month or about once several month.

The controller 80, the driver IC 55, the maintenance control section 82, and the maintenance unit 200 of this embodiment provide an example of the "recovering mechanism" of the present teaching. The controller 80 of this embodiment provides an example of the "elapsed time judging mechanism" of the present teaching.

Next, an explanation will be made with reference to FIGS. 8 to 10 about a method for producing the ink-jet head 1 according to this embodiment. The ink-jet head 1 includes the respective plates 11 to 14 which are stacked and joined. Accordingly, the ink-jet head 1 is produced.

Figure 8:
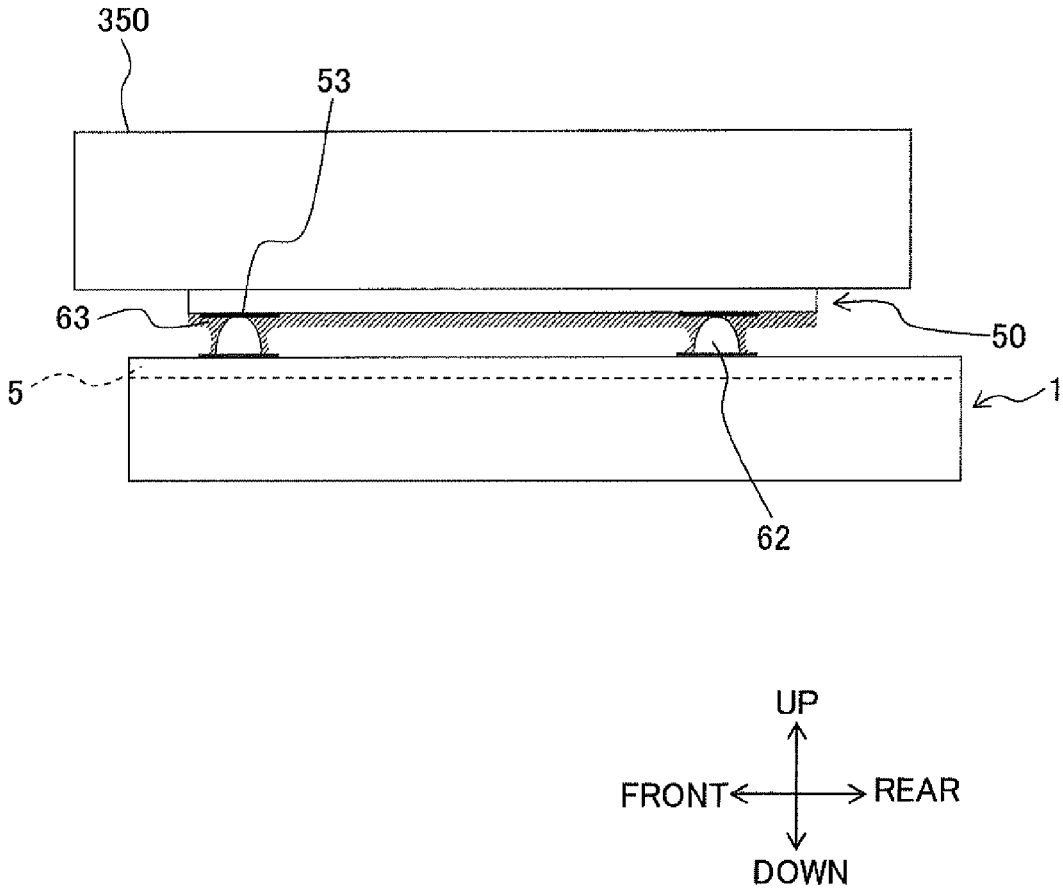
FIG. 8 shows a side view illustrating a connecting step of connecting the piezoelectric actuator 5 and FPC 50.

As shown in FIG. 8, the lands 53 of FPC 50 are connected to the bumps 62 formed for the piezoelectric actuator 5 (hereinafter called as "connecting step"). In this procedure, FPC 50 is pressed against the piezoelectric actuator 5 by means of a pressurizing heating apparatus 350. Accordingly, the bumps 62 of the piezoelectric actuator 5 penetrate through the synthetic resin layer 63 of FPC 50, and the bumps 62 are brought in contact with the lands 53 of FPC 50. The heating is effected by the pressurizing heating apparatus 350 in the state in which the bumps 62 and the lands 53 are brought in contact with each other, and thus the synthetic resin layer 63 is cured or solidified to effect the connection.

Figure 9:
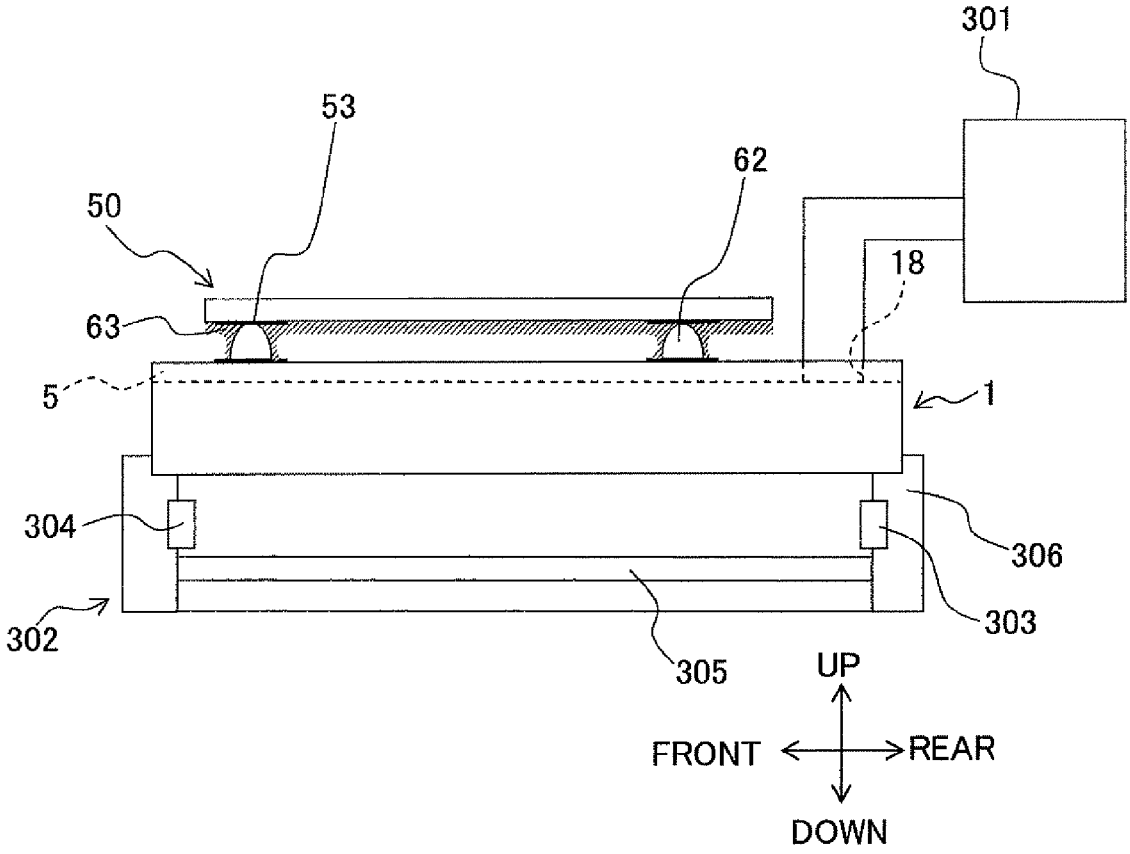
FIG. 9 shows a side view illustrating an inspection unit connecting step of connecting an inspection unit 301 to the ink jet head 1.
Figure 10:
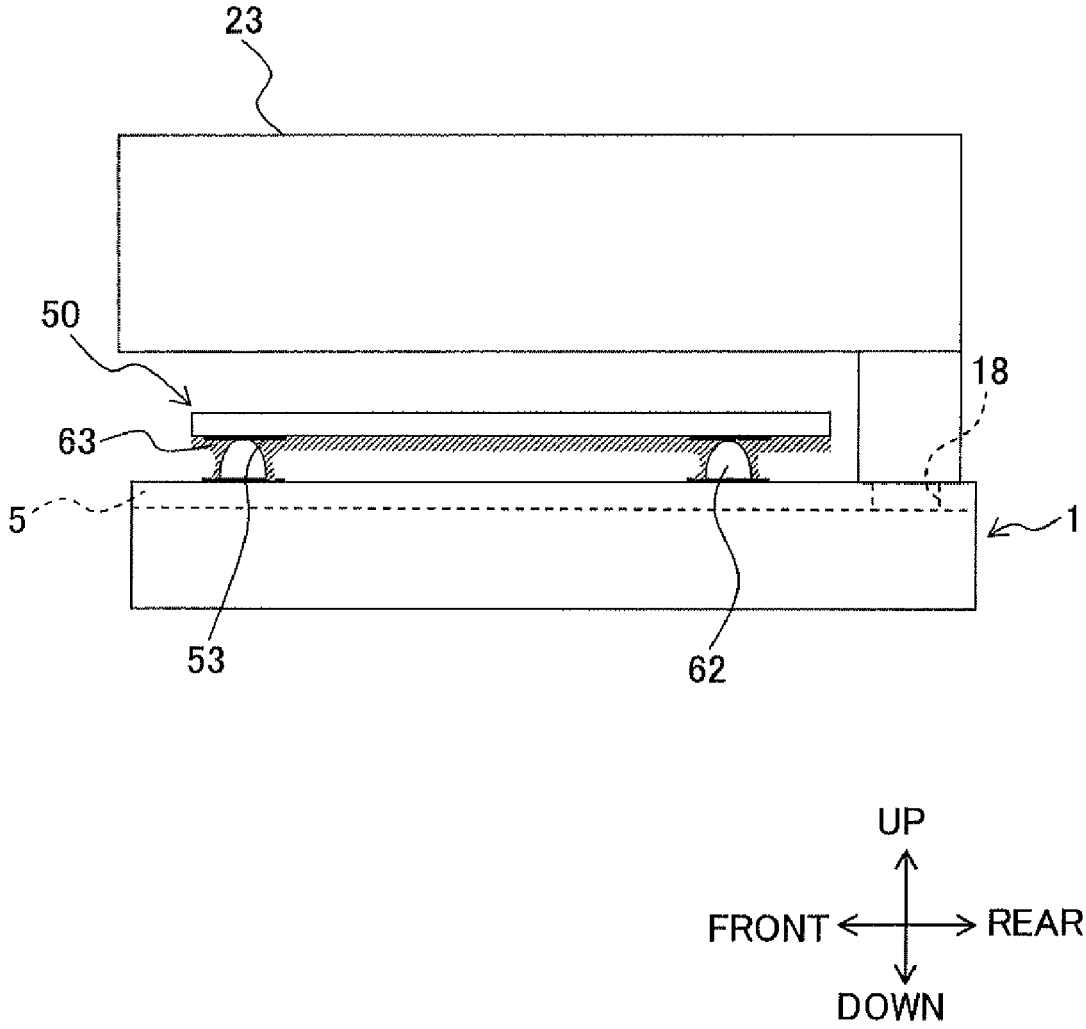
FIG. 10 shows a side view illustrating a liquid discharge head assembling step of communicating a subtank 23 with the ink-jet head 1.

Subsequently, as shown in FIG. 9, an inspection unit 302, which is used for the connection inspection, is communicated with the ink supply port 18 of the ink-jet head 1 (hereinafter called as "inspection unit communicating step"). The inspection unit 301 is provided with a storage tank (not shown) which stores the ink to be used for the inspection, and a communication channel which is to be communicated with the supply port of the ink-jet head 1. After the inspection unit 301 is communicated with the ink-jet head 1, the inspecting ink is supplied from the storage tank to the ink-jet head 1 so that the interior of the ink-jet head 1 is filled with the inspecting ink by means of a supply pump provided at an intermediate position of the communication channel (hereinafter called as "inspecting liquid supplying step"). The inspecting ink is the same as the ordinary ink to be used for the printing. In this procedure, before the inspection unit 301 is communicated with the ink-jet head 1, FPC 50 is connected to PC (not shown) via a circuit board (not shown) which is mounted with, for example, ROM stored with various programs for driving the driver IC 55. The driver IC 55 is also mounted on FPC 50. When a user operates PC, the signal can be supplied from the driver IC 55 to the piezoelectric actuator 5. The ink-jet head 1 is connected to an inspection apparatus 302. The inspection apparatus 302 is provided with a light-emitting section 303 which emits the laser, a light-receiving section 304 which receives the laser, and a receiving section 305 which receives the ink, in the same manner as the dot missing detecting device 201 described above. The light-emitting section 303 may not be an apparatus of emitting the laser. For example, a light-emitting diode may be used in place of the apparatus of emitting the laser. Further, the inspection apparatus 302 is provided with a base 306 which holds the ink-jet head 1. When the inspection is performed, the ink-jet head 1 is held by the base 306. The arrangement is made such that the flying ink liquid droplets are allowed to travel across the laser radiated from the light-emitting section 303 when the liquid droplets of the inspecting ink discharged from the nozzles 20 are allowed to fly normally in the state in which the ink-jet head 1 is held by the base 306 as described above.

The connection inspecting signal is supplied from the driver IC 55 to the piezoelectric actuator 5 in the state in which the interior of the ink-jet head 1 is filled with the inspecting ink in accordance with the inspecting liquid supplying step described above (hereinafter called as "supplying step"). During the supplying step, it is detected by the inspection apparatus 302 whether or not the liquid droplets of the inspecting ink are discharged from the nozzles 20 (hereinafter called as "first detecting step"). If the inspection apparatus 302 detects that the liquid droplets of the inspecting ink are discharged from the nozzles 20 in accordance with the first detecting step, it is judged that the connection between the lands 53 and the bumps 62 corresponding to the nozzles 20 is the normal connection. On the other hand, if the inspection apparatus 302 detects that the liquid droplets of the inspecting ink are not discharged from the nozzles 20, it is judged that the connection between the lands 53 and the bumps 62 corresponding to the nozzles 20 is not the normal connection (hereinafter called as "first judging step").

If it is judged in the first judging step that the connection between the lands 53 and the bumps 62 is the normal connection, then the inspection unit 301 is detached from the ink-jet head 1, and the ink-jet head 1 is detached from the inspection apparatus 302. As shown in FIG. 10, the subtanks 23 are communicated with the ink-jet head 1. In this way, the ink-jet head 1 is assembled (hereinafter called as "liquid discharge head assembling step"). If it is judged that the connection between the lands 53 and the bumps 62 is not the normal connection, then the ink-jet head 1 is detached from the inspection unit 301, and then the ink-jet head 1 is discarded without being connected to the subtanks 23.

According to the production method described above, when the ink-jet head 1 is produced, the ink can be supplied to the ink-jet head 1 without assembling the ink-jet head 1 to the printer 100 so that the inks are supplied from the ink cartridges to the ink-jet head 1 in order to inspect the connection between the lands 53 of FPC 50 and the bumps 62 of the piezoelectric actuator 5. When the inspecting ink is supplied to the ink-jet head 1, the inspecting ink is in a fresh state in which the inspecting ink does not suffer from, for example, the increase in the viscosity. Therefore, the connection is not inspected in a state in which the viscosity is increased, for example, due to the drying, unlike the ink stored for a long period of time in the ink-jet head 1. Therefore, when the connection is inspected, it is possible to avoid such a situation that the ink is not discharged from the nozzles due to the increase in the viscosity of the ink. When FPC 50 is connected to the ink-jet head 1, the lands 52 and the bumps 62 are joined to one another while being covered with the synthetic resin layer 63 without using any conductive material including, for example, the solder. Accordingly, it is possible to avoid such a situation that the solder in the uncured state is spread before the solidification, and FPC 50 and the piezoelectric actuator 5 are arranged closely to one another when any conductive material such as the solder or the like is used as in the conventional technique.

The ink is supplied to the ink-jet head 1 by communicating the inspection unit 301 for supplying the ink to be used for the inspection with the ink-jet head 1. Further, the piezoelectric actuator 5 is electrically connected to PC via FPC 50. Therefore, the connection inspecting signal can be supplied to the driver IC 55 mounted on FPC 50. Further, it is possible to detect whether or not the ink is discharged from the nozzles 20 by means of the inspection apparatus 302 for detecting whether or not the ink is discharged from the nozzles 20. In this way, when the connection inspection is performed for the lands 53 and the bumps 62, the inspecting ink can be supplied to the ink-jet head 1. Therefore, it is possible to avoid the discharge failure which would be caused such that the ink is not discharged from the nozzles 20 due to the drying of the ink exposed to the atmospheric air from the nozzles 20 when the ink stored for a long period of time in the ink channel of the ink jet head 1 is used. Therefore, it is possible to correctly perform the inspection when the connection between the lands 53 and the bumps 62 is inspected. The inspecting ink is not limited to the ink which is equivalent to the ink to be employed for the ordinary use. The inspecting ink may be, for example, a storage solution (liquid for preservation).

Next, an explanation will be made about modified embodiments in which various modifications are applied to the embodiment described above. However, the components or parts, which are constructed in the same manner as in the embodiment described above, are designated by the same reference numerals, any explanation of which will be appropriately omitted.

First Modified Embodiment

In the embodiment of the present teaching, the flashing operation is performed before supplying the connection inspecting signal to the ink-jet head 1 in order to release or recover the nozzles 20 from the drying as shown in Step S1 in FIG. 6. The present teaching is not limited thereto. It is not necessarily indispensable to perform the flashing operation. The purge operation may be perform in place of the flashing operation or in addition to the flashing operation. Alternatively, as explained below, it is also allowable to detect whether or not the ink is discharged from the nozzles 20 when the flashing operation is performed.

Figure 11A:
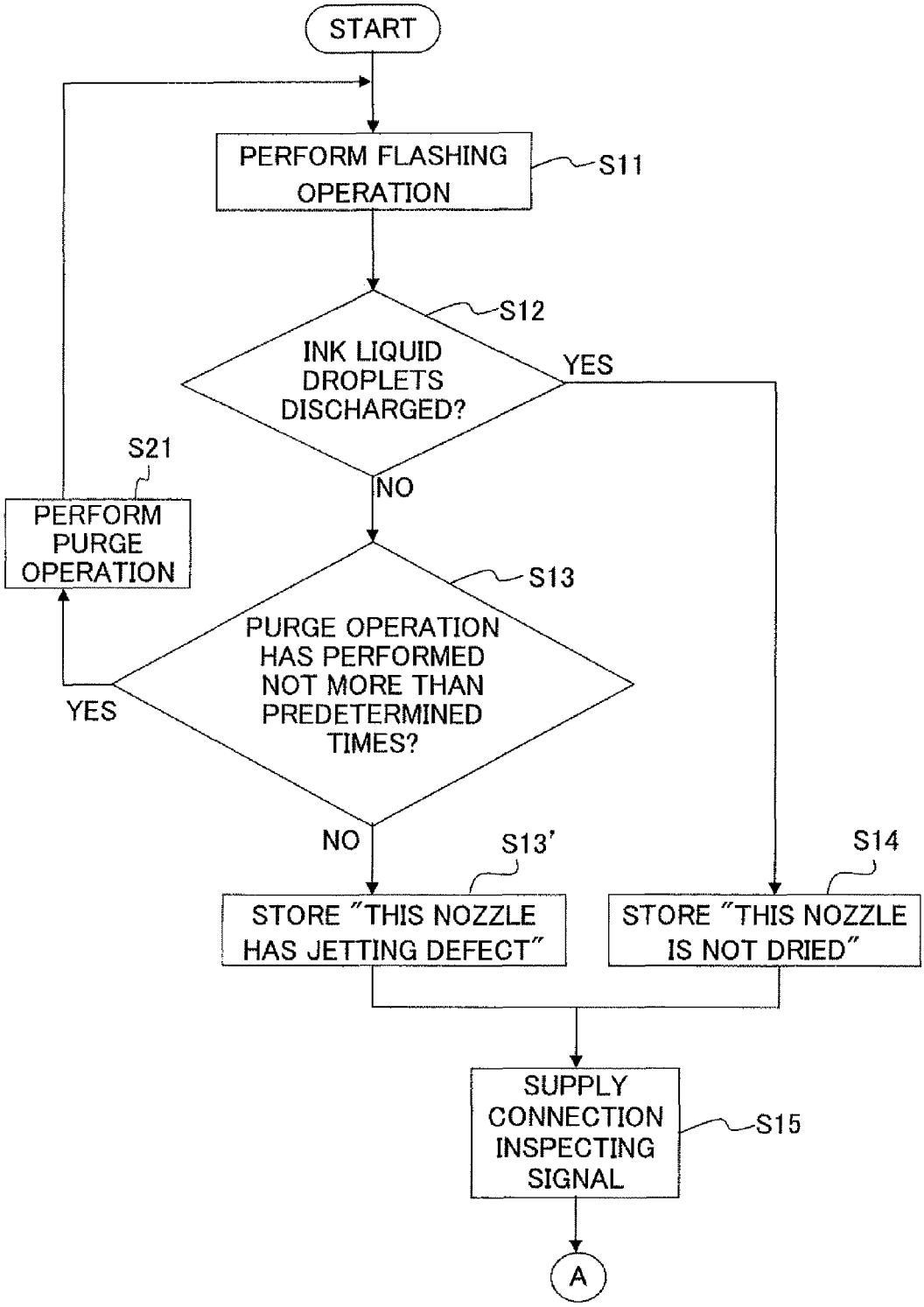
FIGS. 11A and 11B show flow charts illustrating the connection inspection carried out in a first modified embodiment.
Figure 11B:
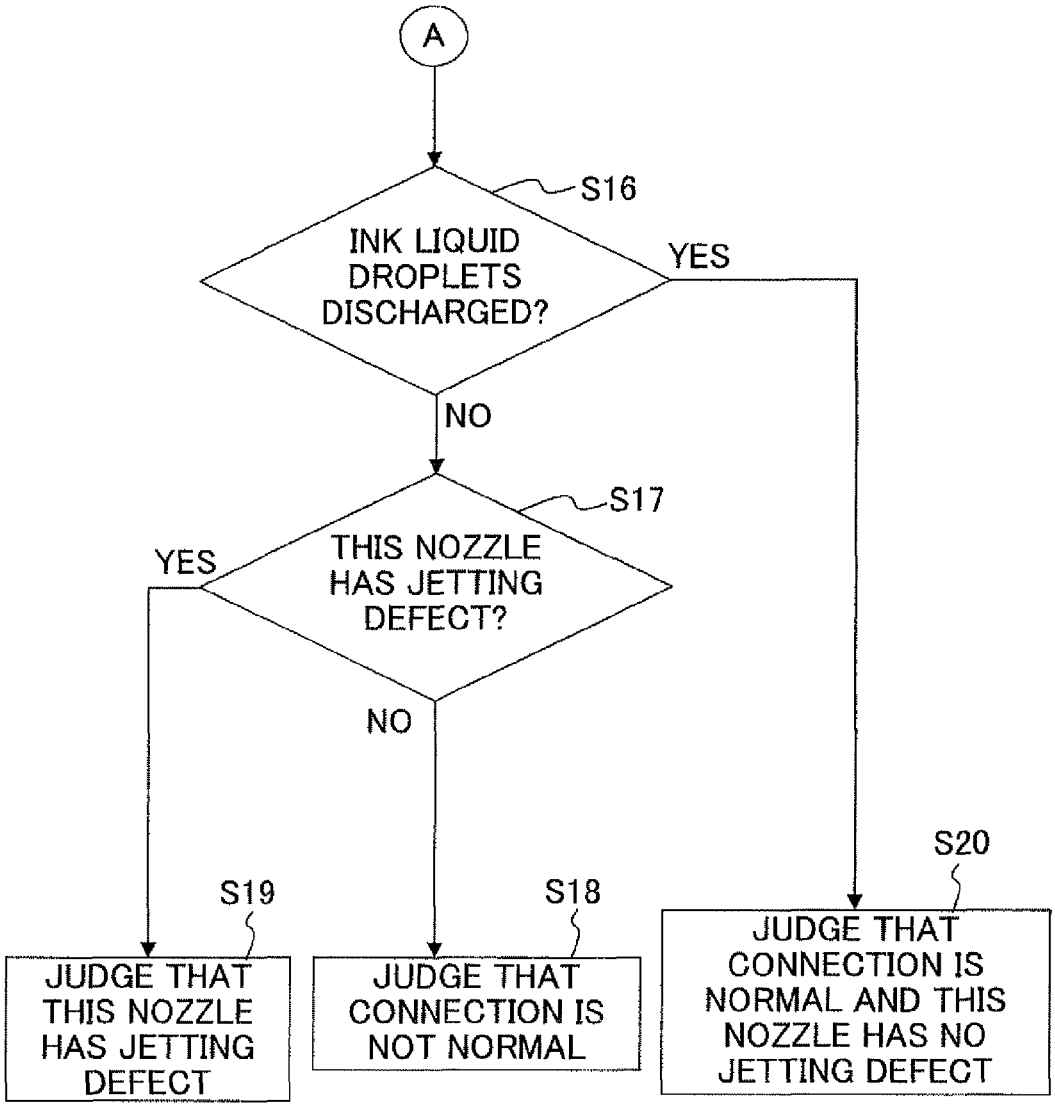

As shown in FIG. 11, the controller 80 controls the printing control section 81 so that the flashing signal is supplied from the driver IC 55 to the ink-jet head 1 after positioning the ink jet head 1 at the position opposed to the dot missing detecting device 201 (S11). It is detected whether or not the ink liquid droplets are discharged from the nozzles 20 after a predetermined period of time elapses after the supply of the flashing signal (S12). If the detection control section 82 detects that the ink liquid droplets are discharged from the nozzles 20 (S12: YES), it is judged that the nozzles 20, for which the discharge of the ink liquid droplets is detected, are not dried, and this judgment is stored (S14). If it is judged that the nozzles 20 are not dried, the process proceeds to the next connection inspection. On the other hand, if the detection control section 82 detects that the ink liquid droplets are not discharged from the nozzles 20 (S12: NO), and the number of times of the purge operation (S22) described later on is not more than a predetermined number of times (S13: YES), then it is judged that the nozzles 20, for which the discharge of the ink liquid droplets is not detected, are highly possibly dried, the purge operation (S22) is performed, and the flashing operation is subsequently performed again. If it is judged that the nozzles 20 are not dried (S14) as a result of the flashing operation S11 performed again, the process also proceeds to the next connection inspection in the same manner as described above. In this procedure, if the nozzles are dried, the drying of the nozzles can be usually eliminated by repeating the purge operation (S22) several times. Therefore, if the ink liquid droplets are not discharged from the nozzles 20 (S13: NO) even when the purge operation (S22) is repeated several times (predetermined number of times), there is such a high possibility that the discharge malfunction or discharge failure may arise in the nozzles 20 due to any cause other than the nozzle drying. In this case, the fact that the discharge failure, which is caused by any reason other than the drying, arises in the concerning nozzles 20 is stored (S13'), and the process proceeds to the next connection inspection in order to detect the defective connection for other nozzles. For example, the disengagement of the connection between the lands 52 and the bumps 62 is assumed as the cause of the discharge failure other than the nozzle drying. The predetermined number of time or times of the purge operation in the embodiment described above is preferably one or two. In this way, whether or not the respective nozzles 20 are dried and whether or not the discharge failure arises due to any other reason are stored in RAM, and then the connection inspection is performed. The connection inspecting signal is supplied from the driver IC 55 to the ink-jet head 1 (S15). After a predetermined period of time elapses after the supply of the connection inspecting signal, it is detected whether or not the ink liquid droplets are discharged from the nozzles 20 (S16). If it is judged that the ink liquid droplets are not discharged from the nozzles 20 (S16: NO), it is judged whether or not the concerning nozzles 20 are the nozzles in which the discharge failure arises (S17). If it has been judged that the discharge failure does not arise in the nozzles 20 (S17: NO), it is judged that the connection between the lands 52 and the bumps 63 corresponding to the concerning nozzles 20 is not the normal connection (S18). On the other hand, if it has been judged that the defective discharge arises in the concerning nozzles 20 (S17: YES), it is judged that the defective discharge arises in the nozzles 20 (S19).

Further, if it is judged that the ink liquid droplets are discharged from the nozzles 20 (S16: YES), it is judged that the connection between the lands 53 and the bumps 62 corresponding to the concerning nozzles 20 is the normal connection, and the defective discharge does not arise as well, which would be otherwise caused, for example, by the drying of the nozzles 20 (S21).

According to the inspecting steps as described above, it is possible to inspect whether or not the nozzles 20 are dried before performing the connection inspection for the lands 52 and the bumps 63. In this procedure, the flashing signal, which is supplied to the ink-jet head 1, is the same as or equivalent to the signal to be used for the ordinary printing. When the flashing signal is supplied, even if the connection between the lands 52 and the bumps 63 is not the normal connection, then the ink liquid droplets are discharged from the nozzles 20, unless any serious defective connection, in which the connection between the lands 52 and the bumps 63 is, for example, completely disengaged, is caused. However, when the nozzles 20 are dried, even if the flashing signal as described above is supplied to the ink-jet head 1, then the ink liquid droplets are not discharged from the nozzles 20. On the contrary, if the ink liquid droplets are not discharged from the nozzles 20 when only the connection inspecting signal is supplied to the ink-jet head 1, then it is impossible to distinguish the fact that the nozzles 20 are dried and the fact that the connection between the lands 52 and the bumps 63 is not the normal connection. When the two signals of the flashing signal and the connection inspecting signal are supplied to detect whether or not the ink liquid droplets are discharged from the nozzles 20 as described above, it is possible to distinguish and judge the fact that the nozzles 20 are dried and the fact that the connection between the lands 52 and the bumps 63 is not the normal connection.

Second Modified Embodiment

The connection inspection of the embodiment of the present teaching may further include a wiping step of wiping out the lower surface 13*a* (see FIG. 3) on which the nozzles 20 are open, by means of a wiper 210 (see FIG. 1) after supplying the flashing signal.

When the flashing operation is performed, the ink is adhered to the lower surface (nozzle opening surface) 13*a* (see FIG. 3) on which the nozzles 20 are open. In particular, if the connection inspecting signal is supplied to the ink-jet head 1 in a state in which the ink is adhered to the portions disposed in the vicinity of the nozzles 20, the adhered ink falls in some cases. Therefore, when the connection inspecting signal is supplied, even if the connection between the lands 53 and the bumps 62 is not the normal connection, then the ink adhered to the lower surface 13*a* (see FIG. 3) falls to the dot missing detecting device 201, and it is detected that the ink liquid droplets are discharged from the nozzles 20 in some cases. However, the wiping step is provided before supplying the connection inspecting signal. Therefore, when the flashing signal is supplied, the ink, which is adhered to the portions disposed in the vicinity of the nozzles 20, can be removed by means of the wiper 210 (see FIG. 1). It is possible to avoid such a state that the ink is adhered to the portions disposed in the vicinity of the nozzles 20 when the connection inspecting signal is supplied. Accordingly, it is possible to improve the inspection accuracy of the connection inspection.

In the embodiment described above and the modified embodiments thereof, an optical detection of whether or not the ink is discharged from the nozzle is performed by using the dot missing detecting device. However, the present teaching is not limited thereto. An arbitrary detector which is capable of detecting whether or not the ink is discharged from the nozzle can be used. In the embodiment described above and the modified embodiments thereof, one type of waveform is assumed as the connection inspecting signal. However, the present teaching is not limited thereto. For example, the waveform of the connection inspecting signal may be appropriately adjusted depending on, for example, the type of the ink and/or the state of the ink (ink temperature, elapsed time after the cartridge installation). Alternatively, when a quality inspection of the ink jet head is performed to make demarcations according to rank, the waveform of the connection inspecting signal may be appropriately adjusted depending on the rank. In particular, the temperature of the ink greatly affects the viscosity of the ink. Therefore, a plurality of types of connection inspecting signals, which have different waveforms, may be prepared, and the connection inspecting signal may be appropriately selected depending on the temperature of the ink. Alternatively, when the inspection is performed for the connection, the temperature of the ink may be adjusted so that a predetermined ink temperature is obtained. When the temperature of the ink is measured, it is not necessarily indispensable that the temperature of the ink should be measured directly. It is also allowable to measure the environmental temperature in the printer and/or the temperature of any member having its temperature which is changed depending on the temperature of the ink.

The embodiment of the present teaching and the modified embodiments thereof have been explained as exemplified by the ink-jet head 1 based on the use of the piezoelectric actuator 5 by way of example. However, the present teaching is not limited to the arrangement as described above. The present teaching is also applicable, for example, to an ink-jet head based on the thermal system including a heater in place of the piezoelectric actuator 5, wherein the ink is discharged by utilizing the pressure generated in the ink by heating the ink by means of the heater as described above to generate the bubbles in the ink channels and heating the bubbles so that the bubbles are expanded. The present teaching may be applied to not only the serial type ink-jet head but also the line type ink-jet head which is allocated stationary in the printer.

The embodiment of the present teaching has been explained as exemplified by the printer 100 for printing, for example, the image by discharging the inks toward the printing paper P by way of example. However, the present teaching is applicable, for example, to liquid discharge apparatuses for discharging various liquids including, for example, a liquid discharge apparatus for the industry provided with a liquid discharge head for discharging a conductive liquid for forming a pattern to a wiring board, and a liquid discharge apparatus provided with a liquid discharge head for discharging a resin as a material for an optical waveguide in order to form the optical waveguide.

What is claimed is:

1. A liquid discharge apparatus which discharges a liquid, comprising:

a liquid discharge head having a nozzle which is formed therein and through which the liquid is discharged, a pressure applying mechanism which applies a discharge pressure to discharge the liquid from the nozzle, and a first connecting terminal which is an input terminal of the pressure applying mechanism;

a printed circuit board which has a second connecting terminal electrically connected to the first connecting terminal;

a driver IC which is electrically connected to the printed circuit board and which supplies a signal for driving the pressure applying mechanism to the pressure applying mechanism via the printed circuit board;

a discharge detecting mechanism which detects whether or not the liquid is discharged from the nozzle under a condition that the signal is supplied to the pressure applying mechanism;

a connection inspecting mechanism which inspects electrical connection between the first connecting terminal and the second connecting terminal and which controls the driver IC to supply a connection inspecting signal to the pressure applying mechanism, the connection inspecting signal being set so that the liquid is discharged from the nozzle under a condition that the connection between the first connecting terminal and the second connecting terminal is normal connection, and that the liquid is not discharged from the nozzle under a condition that the connection between the first connecting terminal and the second connecting terminal is not the normal connection; and the connection inspecting mechanism controlling the discharge detecting mechanism to detect whether or not the liquid is discharged from the nozzle under a condition that the connection inspecting signal is supplied to the pressure applying mechanism; and a judging mechanism which performs judgment whether or not the connection between the first connecting terminal and the second connecting terminal corresponding to the nozzle is the normal connection based on a detection result of the discharge detecting mechanism;

wherein the connection inspecting mechanism includes a timer which measures an elapsed time after the electrical connection between the first connecting terminal and the second connecting terminal has been inspected; and an elapsed time judging mechanism which judges whether or not the elapsed time exceeds a predetermined time;

the connection inspecting mechanism controls the driver IC so that the connection inspecting signal is supplied to the pressure applying mechanism under a condition that the elapsed time judging mechanism judges that the elapsed time exceeds the predetermined time, and the connection inspecting mechanism controls the discharge detecting mechanism so that it is detected whether or not the liquid is discharged from the nozzle under a condition that the connection inspecting signal is supplied to the pressure applying mechanism.

2. The liquid discharge apparatus according to claim 1, wherein the first connecting terminal and the second connecting terminal are connected to one another upon being in contact with each other; and a cured synthetic resin layer is arranged to cover the first connecting terminal and the second connecting terminal.

3. The liquid discharge apparatus according to claim 1, wherein the discharge detecting mechanism includes a light-emitting section which emits a light toward the liquid discharged from the nozzle and a light-receiving section which receives the light, and the light-emitting section and the light-receiving section is arranged to sandwich the liquid discharged from the nozzle between the light-emitting section and the light-receiving section.

4. The liquid discharge apparatus according to claim 1 further comprising a recovering mechanism which is configured to recover the nozzle by discharging the liquid from the nozzle so that the liquid is normally discharged from the nozzle, and is configured to perform a recovery of the nozzle before the connection inspecting mechanism controls the driver IC to supply the connection inspecting signal.

5. The liquid discharge apparatus according to claim 4, wherein the recovering mechanism is configured to perform a flushing operation in which a flushing signal is supplied from the driver IC to the pressure applying mechanism to discharge the liquid from the nozzle, the flushing signal being set so that the discharge pressure applied by the pressure applying mechanism is increased as compared with the discharge pressure applied under a condition that the connection inspecting signal is supplied, the detection mechanism is configured to perform a second detection in which whether or not the liquid is discharged from the nozzle is detected under a condition that the flushing signal is supplied to the pressure applying mechanism, in a case of performing the recovery of the nozzle, and the liquid discharge apparatus further comprising a second judging mechanism which is configured to perform a second judgment in which whether or not a discharge failure is caused in the nozzle is judged based on the second detection.

6. The liquid discharge apparatus according to claim 5, wherein the recovering mechanism further includes a wiper which is configured to perform wiping for a nozzle opening surface of the liquid discharge head on which the nozzle is open, and is configured to perform wiping for the nozzle opening surface after performing the second detection, in a case of performing the recovery of the nozzle.

7. The liquid discharge apparatus according to claim 5, wherein the recovering mechanism further includes:

a cap which is configured to cover a nozzle opening surface of the liquid discharge head on which the nozzle is open, a pump which is configured to reduce a pressure in a space communicated with the cap and defined by an interior of the cap and the nozzle opening surface, and a purge mechanism which is configured to perform a purge operation in which the liquid is sucked from the nozzle by reducing the pressure in the space by the pump while the cap is brought in tight contact with the nozzle opening surface under a condition that the second judgment is made that the discharge failure is caused in the nozzle, in a case of performing the recovery of the nozzle.

8. A liquid discharge apparatus which discharges a liquid, comprising:

a liquid discharge head having a nozzle which is formed therein and through which the liquid is discharged, a pressure applying mechanism which applies a discharge pressure to discharge the liquid from the nozzle, and a first connecting terminal which is an input terminal of the pressure applying mechanism;

a printed circuit board which has a second connecting terminal electrically connected to the first connecting terminal;

a driver IC which is electrically connected to the printed circuit board and which supplies a signal for driving the pressure applying mechanism to the pressure applying mechanism via the printed circuit board;

a discharge detecting mechanism which detects whether or not the liquid is discharged from the nozzle under a condition that the signal is supplied to the pressure applying mechanism;

a connection inspecting mechanism which inspects electrical connection between the first connecting terminal and the second connecting terminal and which controls the driver IC to supply a connection inspecting signal to the pressure applying mechanism, the connection inspecting signal being set so that the liquid is discharged from the nozzle under a condition that the connection between the first connecting terminal and the second connecting terminal is normal connection, and that the liquid is not discharged from the nozzle under a condition that the connection between the first connecting terminal and the second connecting terminal is not the normal connection; and the connection inspecting mechanism controlling the discharge detecting mechanism to detect whether or not the liquid is discharged from the nozzle under a condition that the connection inspecting signal is supplied to the pressure applying mechanism; and a judging mechanism which performs judgment whether or not the connection between the first connecting terminal and the second connecting terminal corresponding to the nozzle is the normal connection based on a detection result of the discharge detecting mechanism;

wherein the liquid discharge head discharges the liquid to a medium from the nozzle, the driver IC supplies, to the pressure applying mechanism, a driving signal as the signal, which makes the pressure applying mechanism apply a discharge pressure to the liquid by which the liquid is discharged to the medium from the nozzle of the liquid discharge head, and a pulse height of the connection inspecting signal is smaller than that of the driving signal.

9. A liquid discharge apparatus which discharges a liquid, comprising:

a liquid discharge head having a nozzle which is formed therein and through which the liquid is discharged, a pressure applying mechanism which applies a discharge pressure to discharge the liquid from the nozzle, and a first connecting terminal which is an input terminal of the pressure applying mechanism;

a printed circuit board which has a second connecting terminal electrically connected to the first connecting terminal;

a driver IC which is electrically connected to the printed circuit board and which supplies a signal for driving the pressure applying mechanism to the pressure applying mechanism via the printed circuit board;

a discharge detecting mechanism which detects whether or not the liquid is discharged from the nozzle under a condition that the signal is supplied to the pressure applying mechanism;

a connection inspecting mechanism which inspects electrical connection between the first connecting terminal and the second connecting terminal and which controls the driver IC to supply a connection inspecting signal to the pressure applying mechanism, the connection inspecting signal being set so that the liquid is discharged from the nozzle under a condition that the connection between the first connecting terminal and the second connecting terminal is normal connection, and that the liquid is not discharged from the nozzle under a condition that the connection between the first connecting terminal and the second connecting terminal is not the normal connection; and the connection inspecting mechanism controlling the discharge detecting mechanism to detect whether or not the liquid is discharged from the nozzle under a condition that the connection inspecting signal is supplied to the pressure applying mechanism; and a judging mechanism which performs judgment whether or not the connection between the first connecting terminal and the second connecting terminal corresponding to the nozzle is the normal connection based on a detection result of the discharge detecting mechanism;

wherein the liquid discharge head discharges the liquid to a medium from the nozzle, the driver IC supplies, to the pressure applying mechanism, a driving signal as the signal, which makes the pressure applying mechanism apply a discharge pressure to the liquid by which the liquid is discharged to the medium from the nozzle of the liquid discharge head, and a pulse width of the connection inspecting signal is smaller than that of the driving signal.

* * * * *